US005682574A

United States Patent [19]

Oshida et al.

[11] Patent Number: 5,682,574

[45] Date of Patent: Oct. 28, 1997

[54] DEVELOPING APPARATUS HAVING RECIPROCATING CLEANING DEVICE FOR PHOTODETECTOR

[75] Inventors: Haruhisa Oshida, Hatogaya; Keiji Okano, Tokyo; Masahide Kinoshita; Koji Takahashi, both of Yokohama; Yasushi Shimizu, Tokyo; Akira Domon, Kawasaki, all of Japan

[73] Assignee: Canon Kabushiki Kaisha, Tokyo, Japan

[21] Appl. No.: 380,414

[22] Filed: Jan. 30, 1995

[30] Foreign Application Priority Data

Jan. 28, 1994 [JP] Japan ..... 6-008567
Jan. 28, 1994 [JP] Japan ..... 6-008569

[51] Int. Cl.[6] ..... G03G 15/10

[52] U.S. Cl. ..... 399/64; 118/691

[58] Field of Search ..... 355/215, 245, 355/246; 118/691, 694; 399/64, 99

[56] References Cited

U.S. PATENT DOCUMENTS

| | | | |
|---|---|---|---|
| 4,135,642 | 1/1979 | Forward et al. | 222/23 |
| 4,901,115 | 2/1990 | Nakamura et al. | 355/246 |
| 4,963,929 | 10/1990 | Ueda et al. | 355/215 |
| 5,036,358 | 7/1991 | Yoshida | 355/203 |
| 5,095,335 | 3/1992 | Watanabe et al. | 355/210 |
| 5,216,462 | 6/1993 | Nakajima et al. | 355/203 |
| 5,239,346 | 8/1993 | Corbin et al. | 355/260 |
| 5,521,684 | 5/1996 | Takahashi | 355/246 |
| 5,532,790 | 7/1996 | Akazawa | 399/64 |
| 5,587,770 | 12/1996 | Jo et al. . | |
| 5,589,918 | 12/1996 | Oshida et al. | 399/114 |

FOREIGN PATENT DOCUMENTS

| | | |
|---|---|---|
| 0330225 | 8/1989 | European Pat. Off. . |
| 0655661 | 5/1995 | European Pat. Off. . |
| 0655662 | 5/1995 | European Pat. Off. . |
| 63-034566 | 2/1988 | Japan . |
| 1-316766 | 12/1989 | Japan . |
| 1-319065 | 12/1989 | Japan . |
| 3-164768 | 7/1991 | Japan . |
| 04242275 | 8/1992 | Japan . |

*Primary Examiner*—Robert Beatty
*Attorney, Agent, or Firm*—Fitzpatrick, Cella, Harper & Scinto

[57] ABSTRACT

A developing apparatus for developing a latent image formed on an electrophotographic photosensitive member include a toner container for containing toner to be used for developing the latent image, a light transmitting member for transmitting light for detecting that an amount of the toner in the toner container is smaller than a predetermined level, a cleaning member for cleaning the light transmitting member, a stirring member reciprocating device for reciprocating a stirring member, and a cleaning member reciprocation device for reciprocating the cleaning member with a degree of displacement larger than that of the stirring member.

52 Claims, 18 Drawing Sheets

DEVELOPING APPARATUS HAVING RECIPROCATING CLEANING DEVICE FOR PHOTODETECTOR

FIELD OF THE INVENTION AND DESCRIPTION OF THE RELATED ART

The present invention relates to a developing apparatus, a process cartridge, an image forming apparatus, and a method for assembling the process cartridge.

As for a structure for detecting the presence or absence of the remaining amount of toner in the electrophotographic apparatus or the like, a light transmitting type detecting system has been known, which employs a photointerruptor comprising a light emitting element and an opposing light receiving element (for example, Japanese Laid-Open Patent Application No. 1-319065.

More specifically, a light transmitting window is provided in the top and bottom walls of a toner storing container, and a light transmitting member is fitted in the windows. The light emitting element is disposed next to one of the windows and the light receiving element is disposed next to the other, so that the light can be is passed through the toner storing container. With this arrangement in place, the light from the light emitting element can be transmitted through the container when the toner is not present in the container, but is blocked by the toner when the toner is in the container, thus being prevented from reaching the light receiving element. Thus, the presence or absence of the toner can be determined on the basis of the output value of the light receiving element.

In such an structure, the light transmitting member has to be cleaned since toner is deposited thereon in use. A conventional toner container is cylindrical, and has a rotatable toner stirring member, which is provided with a flexible member for contacting an inner surface of the container. With the rotation of the stirring member, the flexible member can wipe the light transmitting member, thus removing the toner therefrom The present invention further improves this structure.

SUMMARY OF THE INVENTION

A principal object of the present invention is to provide a developing apparatus, process cartridge, image forming apparatus and an assembling method for a process cartridge, capable of accurately detecting a remaining amount of the toner.

Another object of the present invention is to provide a developing apparatus, process cartridge, image forming apparatus and an assembling method for a process cartridge wherein the cleaning effect of a light transmitting member has been improved.

A further object of the present invention is to provide a developing apparatus, process cartridge, image forming apparatus and an assembling method for a process cartridge wherein a light transmitting member is cleaned by reciprocation of the stirring member.

A yet further object of the present invention is to provide a developing apparatus, process cartridge, image forming apparatus and an assembling method for a process cartridge wherein the size is reduced, and the toner container is not limited to a cylindrical shape, with high cleaning effect.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

To begin with, a first embodiment of the present invention will be described as a preferable embodiment of the present invention, to be followed by second and third embodiments, as well as other embodiments.

EMBODIMENT 1

The first embodiment of the present invention, in which the present invention is applied to an electrophotographic facsimile apparatus, will be described in detail with reference to the drawings, wherein the description will be made in the following order.

(1) Overall structure of the facsimile apparatus.

(2) Structure of a reading apparatus for reading information.

(3) Structures of various components in an image forming apparatus for recording the received information.

(4) Structure of various members in a process cartridge to be used with the image forming apparatus.

(5) Structure of stirring means for stirring the toner within a toner storing container.

(6) Structure of remaining amount detecting means for detecting the remaining amount of the toner within the toner storing container.

(7) Structure of cleaning means for cleaning a light transmitting window used for detecting the remaining amount of the toner.

(8) Structure and assembly of the process cartridge.

(9) Relation between the opening and closing movements of a shutter member, and the light transmitting window.

(Overall structure of electrophotographic facsimile apparatus)

Figure 1:
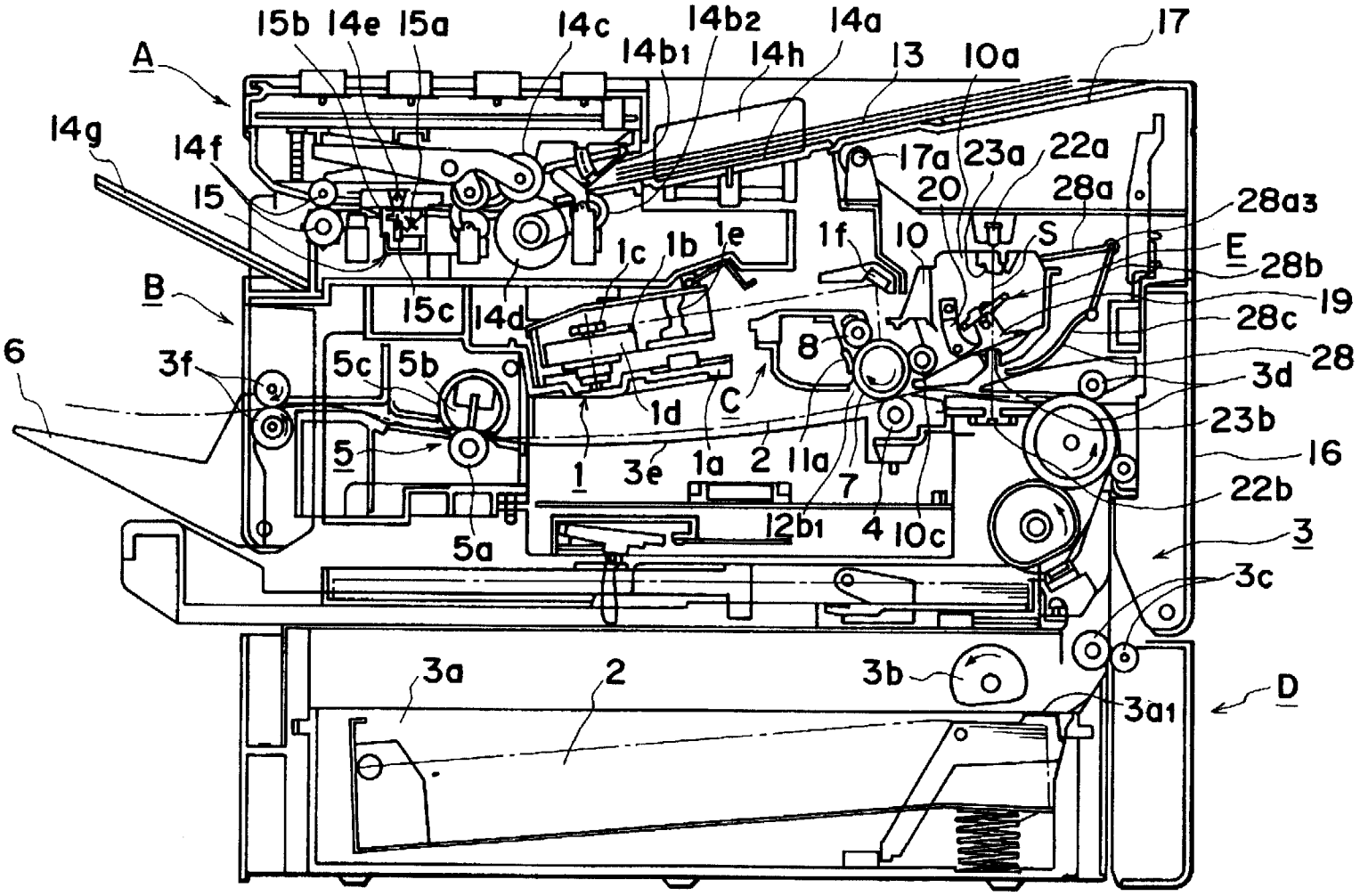
FIG. 1 is an explanatory structural view of an embodiment of facsimile apparatus according to the present invention.
Figure 2:
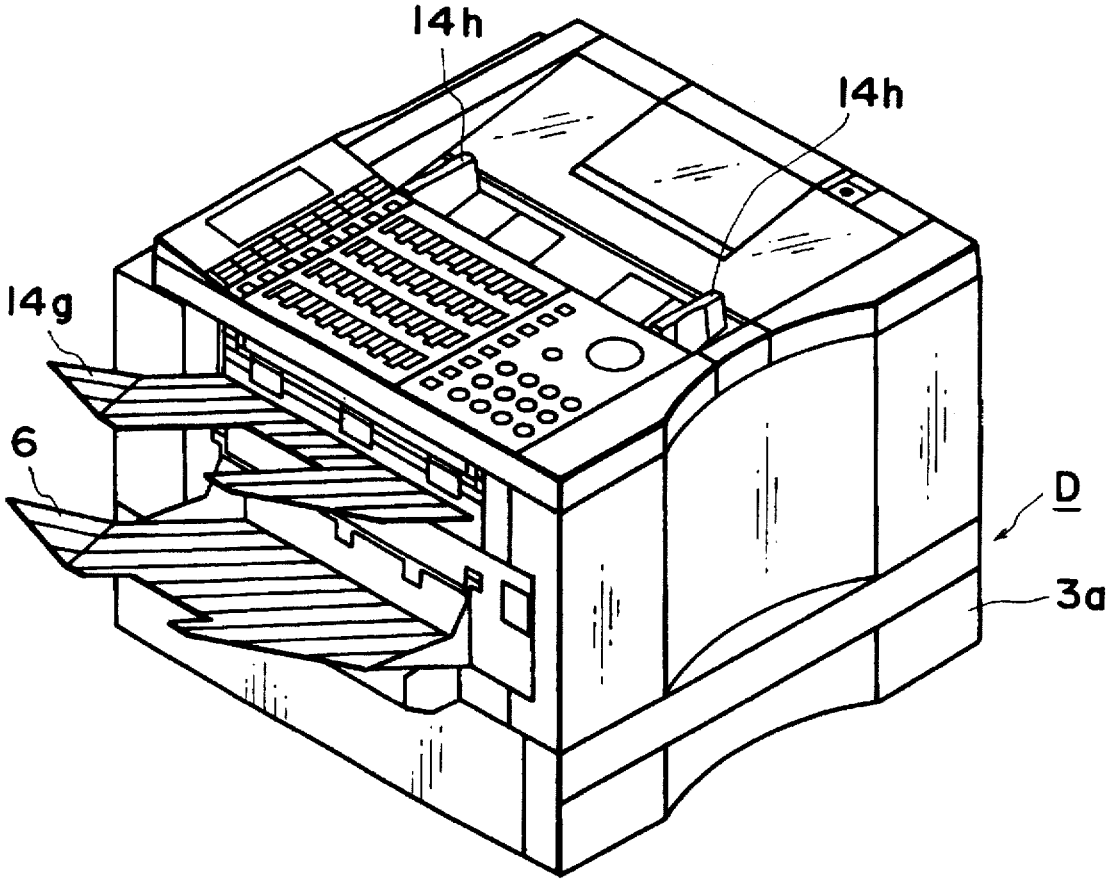
FIG. 2 is a perspective external view of the facsimile apparatus.
Figure 3:
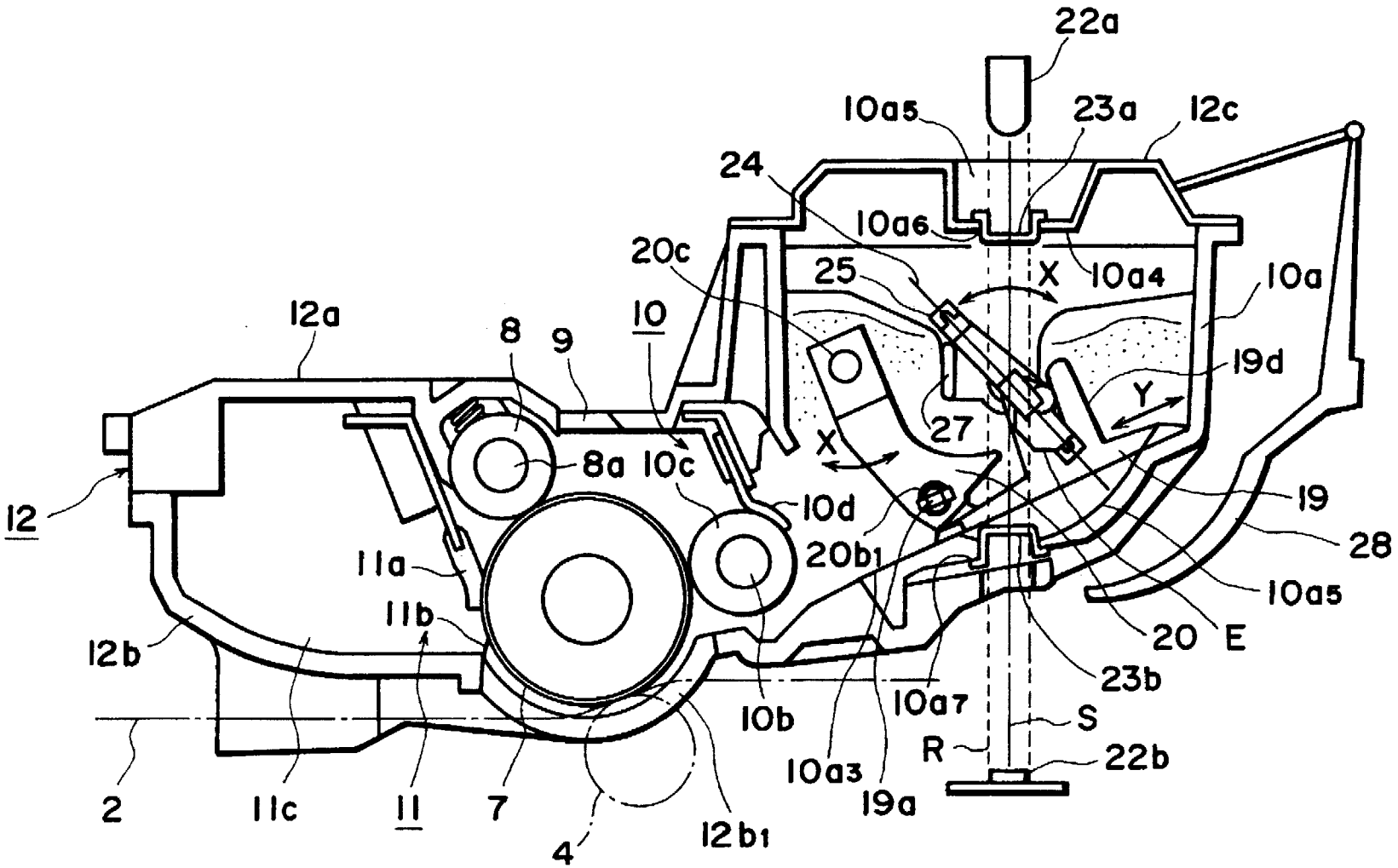
FIG. 3 is an explanatory structural view of a process cartridge.
Figure 4:
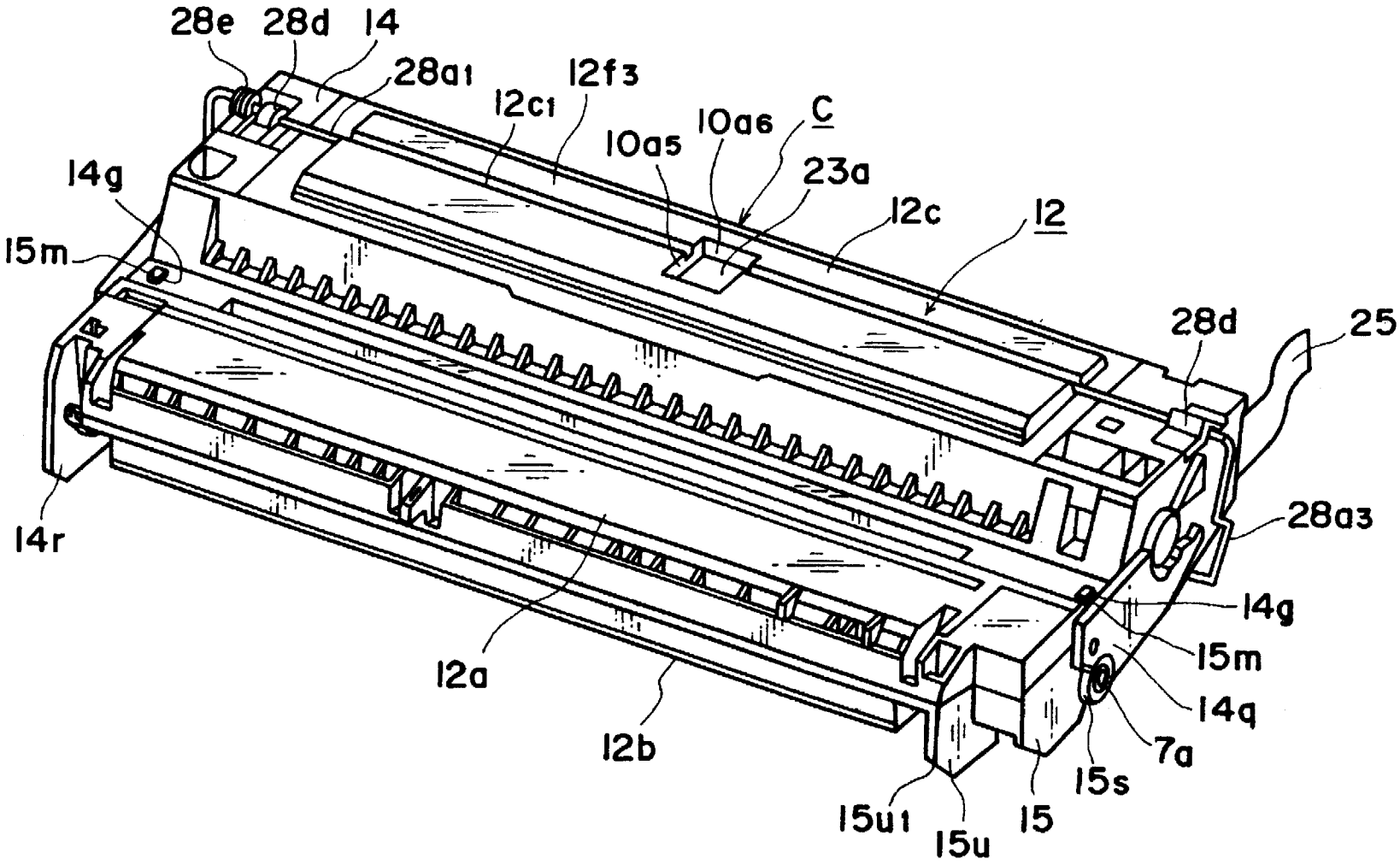
FIG. 4 is a perspective external view of the process cartridge.

FIG. 1 is an explanatory structural view of a facsimile apparatus comprising an image forming apparatus fitted with a process cartridge in accordance with the present invention, and FIG. 2 is a perspective external view thereof. FIG. 3 is an explanatory structural view of the aforementioned process cartridge, and FIG. 4 is a perspective external view thereof.

Referring to FIG. 1, this facsimile apparatus comprises an original reading apparatus A disposed in the top portion thereof, and an image forming apparatus B disposed in the bottom portion. The information read by the reading apparatus A is transmitted to another facsimile apparatus located at a different location when in a facsimile mode, and is recorded by its own image forming apparatus B when in a copy mode.

The image forming apparatus B forms a toner image on a photosensitive drum, that is, an image bearing member, by projecting an optical image in accordance with the image information, from an optical means 1, as illustrated in FIG. 1, and in synchronism with the formation of the toner image, a according medium 1 is delivered by a conveying means 3. The toner image formed on the photosensitive drum is transferred onto the recording medium 2 by a transferring means 4 in an image forming portion in a process cartridge C, and then, the recording medium now carrying the toner image is delivered to a fixing means 5, where the transferred toner image is fixed. Then, the recording medium 2 is discharged into a discharge tray 6.

Referring to FIG. 3, in the process cartridge C comprising the aforementioned image forming portion, the surface of a photosensitize drum 7 is uniformly charged by a charging means 8 as it is rotated, and is exposed to an optical image projected from the aforementioned optical system 1, in an exposing portion 9, whereby a latent image is formed on the photosensitive drum 7. The latter image is visualized as a toner image by a developing means 10. After the toner image is transferred onto the recording medium 2 by the transferring means 4, the toner remaining on the photosensitize drum 7 is removed by cleaning means 11. It should be noted that various components of the photosensitive drum 7 are contained in a housing 12 constructed in a form of cartridge by joining a top frame member **12*a* which is the first frame formed of resin material, and a bottom frame member 12*b*** which is the second frame.

These are provided in the toner storing container of the process cartridge C, stirring means for stirring the toner and cleaning means for cleaning a light transmitting member, and further, remaining amount detecting means for detecting the amount of the toner remaining in the toner storing container is provided on the main assembly side.

(Reading apparatus)

An original 13 is passed through the reading apparatus A so that the image information can be read from the original 13. A set of the originals 13 accumulated on the original table **14*a* is separated one by one by a pre-delivery roller 14*b*2 pressing upon a pre-delivery pressing piece 14*b*1, and a separating roller 14*d* pressing upon a reversing roller 14*c*. The separated original 13 is tightly pressed upon a contact type sensor of the reading means 15 by pressing means 14*e*, so that the image information of the original 13 is read. After the image information is read, the original 13 is discharged into an original discharge tray 15*g* by a discharging roller 14*f***.

The reading means 15 irradiates light upon the original 13 surface carrying the image information from an LED **15*a* as a light source. The light reflected from the surface is projected through an image forming lens 15*b* with a short focal distance, to form an optical image on a photoelectric transducer element 15*c***, which reads the image information and outputs corresponding signal. When in the facsimile mode, the signal thus obtained is transmitted to another facsimile apparatus by controlling means, which will be described later, and when in the copy mode, it is transmitted to its own image forming apparatus.

The original table **14*a* is provided with a slider 14*h* slidable in the direction (width direction to of the original 13) perpendicular to the direction in which the original 13 is conveyed. The lateral edges of the originals 13 accumulated on the original table 14*a* are aligned by sliding this slider 14*h*** in the aforementioned direction.

(Image forming apparatus)

Next, the structures of various portions of the image forming apparatus B, which forms an image in response to the recording signal, will be described in the order of (1) Optical means, (2) Conveying means, (3) Transferring means, (4) Fixing means, and (5) Cartridge installing means.

(Optical means)

An optical means 1 irradiates light in response to the image information read through an external apparatus, the reading means 15, or the like means, so as to project an optical image on the photosensitive drum 7. Referring to FIG. 1, a laser diode **1*b*, a polygon mirror 1*c*, a scanner motor 1*d*, and an image forming lens 1*e* are contained in an optical unit 1*a***.

As an image signal is sent in by the external apparatus, for example, another facsimile apparatus, the laser diode **1*b* emits light in response to the image signal, and this emitted light is projected as the image forming light to the polygon mirror 1*c*, which is rotated at a high speed by the scanner motor 1*d*. The image forming light reflected by the polygon mirror is projected upon the rotating photosensitive drum 7 by way of the image forming lens 1*e* and the reflection mirror 1*f*, so as to expose selectively the surface of the photosensitive drum 7**, whereby a latent image correspondent to the image information is formed.

(Recording medium conveying means)

The conveying means 3 for conveying the recording medium 2 (for example, recording paper, OHP sheet, cloth, thin plate, or the like) is disposed in the bottom portion of the image forming apparatus B. The sheets of the recording medium 2 accumulated within a feeder cassette **3*a*, which is removably inserted from the sheet feeding portion D, are separated one by one from the topmost sheet, by a separating claw 3*a*1 disposed at a location corresponding to the leading corner of the recording medium 2, and a feeding roller 3b shaped like a partially cut off cylinder, and then, is sent to a conveyer roller pair 3d by a cassette conveyer roller pair 3c, wherein the recording medium 2 is delivered to the image transferring portion in synchronism with the image forming operation, by this conveyer roller pair 3d. After the image transfer, the recording medium 2 is delivered to the fixing means 5 by a guiding plate 3e, and after the image fixing, the recording medium 2 is discharged into a discharge tray 6 by a discharging roller pair 3f**.

(Transferring means)

The transferring means 4 transfers the toner image having been formed on the photosensitive drum 7 in the image forming portion onto the recording medium 2. In this embodiment, the transferring means comprises a transfer roller 4 as shown in FIG. 1. More specifically, the recording medium 2 is pressed upon the photosensitive drum 7 of the process cartridge having been installed in the image forming apparatus, by the transfer roller 4, and a voltage with a polarity opposite to that of the toner image having been formed on the photosensitive drum 7 is applied to this transfer roller 4, whereby the toner carried on the photosensitive drum 7 is transferred onto the recording medium 2.

(Fixing means)

The fixing means 5 fixes the toner image having been transferred onto the recording medium 2 by the application of the voltage to the transfer roller 4. As for its structure, it comprises a driving roller 5a which drives the fixing means, and a fixing means 5c comprising a heater 5b contained therein and a sheet member, wherein the fixing member 5c is rotated by the driving roller 5a as it is pressed on the driving roller 5a. While the recording medium 2, on which the toner image has been transferred in the image forming portion, is passed between the driving roller 5a and fixing member 5c, a predetermined pressure generated by the both rollers 5a and 5c, as well as the heat generated by the heater 5b, are applied, whereby the toner carried on the recording medium 2 is fixed to the recording medium 2.

(Process cartridge installing means)

Figure 5:
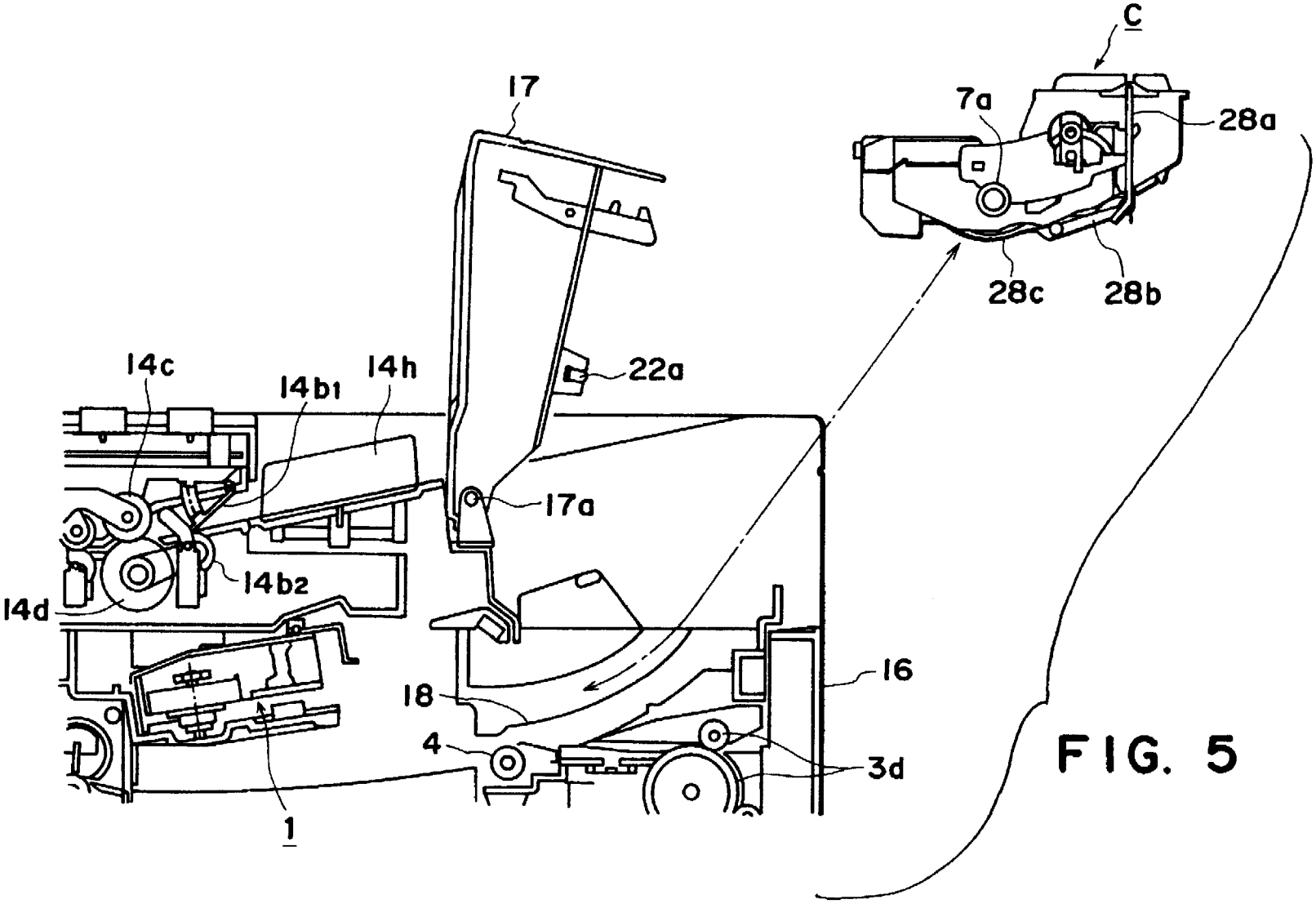
FIG. 5 is an explanatory drawing to describe how the process cartridge is installed.

In the image forming apparatus B, a cartridge installing means for installing the process cartridge C is provided. The installation of the process cartridge C into the main assembly 16 of the image forming apparatus and its removal therefrom are carried out by opening a hinged movable cover 17. More specifically, the movable cover 17 is attached to the top portion of the main assembly 16 with the use of a hinge 17a as illustrated in FIG. 5. With the movable cover 17 open, a space for installing the cartridge is exposed in the apparatus main assembly 16, and a guiding groove 18 is provided on each of the left and right walls of the space. The process cartridge C is inserted in a manner so as to slide a drum axis 7a on this guiding groove 18, and then, the movable cover 17 is closed to complete the installation of the process cartridge C in the image forming apparatus B.

(Process cartridge)

Next, the structures of the various components of the process cartridge C to be installed into the aforementioned image forming apparatus B will be described.

This process cartridge C comprises an electrophotographic photosensitive member, and at least one processing means. The processing means in this case includes, for example, charging means for charging the surface of the electrophotographic photosensitive member, developing means for forming a toner image on an image bearing means, cleaning means for cleaning the toner remaining on the surface of the electrophotographic photosensitive member, or the like means. The process cartridge C of this embodiment comprises an electrophotographic photosensitive drum 7 which is the image bearing member, and charging means 8, an exposing portion 9, developing means 10, and cleaning means 11, which are disposed around the electrophotographic photosensitive drum 7. These components are integrally covered with a housing 12, and then, a shutter member 28 is attached thereon, in such a manner that the process cartridge can be exchangeably installed in the main assembly 16.

Next, the structures of the various portions of the process cartridge C will be described in the order of (1) Photosensitive drum, (2) Charging means, (3) Exposing portion, (4) Developing means, (5) Cleaning means, and (6) Shutter member.

(Photosensitive drum)

The photosensitive drum 7 of this embodiment comprises a cylindrical aluminum drum base and an organic photosensitive layer coated on the peripheral surface of the drum base. This photosensitive drum 7 is rotatively mounted on a frame member. As a driving force from a driving motor provided on the main assembly side is transmitted to a flange gear affixed to one of the longitudinal ends of the photosensitive drum 7 in such a manner that will be described later, the photosensitize drum 7 is rotated in response to the image forming operation, in the direction of an arrow in FIG. 1.

(Charging means)

The charging means uniformly charges the surface of the photosensitive drum 7. In this embodiment a so-called contact charging system is employed, in which the charging roller 8 is rotatively mounted on the frame member. The charging roller 8 comprises a metallic roller shaft 8a, an electrically conductive elastic layer, a high resistance elastic layer, and a protective film, which are laminated around the shaft 8a in this order. The electrically conductive elastic layer is formed of a material composed of elastic rubber such as EPDM, NBR, or the like in which carbon is dispersed, and functions to lead a bias voltage to be supplied to the roller shaft 8a. The high resistance elastic layer is formed of a material composed of urethane rubber or the like in which a minute amount of electrically conductive microscopic particles is contained, and functions to present the sudden drop of the bias voltage by restricting the leak current to the photosensitive drum 7 even when the charging roller 8 makes contact with a pin hole of the photosensitive drum 7 or when a charging roller with higher electrical conductivity is employed. The protective layer is formed of N-methoxymethyl nylon, and functions to prevent the deterioration of the photosensitive drum 7 surface, which is caused by the contact between the photosensitive drum 7 surface and the materials of the electrically conductive layer or high resistance elastic layer.

The charging roller 8 is placed in contact with the photosensitive drum 7. During an image forming operation, the charging roller 8 is rotated by the rotation of the photosensitive drum 7, and at this time, a voltage composed of a DC voltage and an AC voltage superposed thereon is applied to the charging roller 8 to charge uniformly the surface of the photosensitive drum 7.

(Exposing portion)

The exposing portion 9 exposes the surface of the photosensitive drum 7 which has been uniformly charged by the charging roller 8, by projecting an optical image from an optical system, so that an electrostatic latent image is formed on the surface of the photosensitive drum 7. It comprises an opening 9 provided in the upper surface wall of the cartridge frame member for guiding the optical image.

(Developing means)

Referring to FIG. 3, the developing means 10 comprises a toner storing container 10*a* which is a toner containing portion and contains toner, and a reciprocating stirring member which feeds out the toner while stirring it, which will be described later. It further comprises a magnet 10*b* disposed non-rotatively inside the opening of the toner storing container, and a developing sleeve 10*c* which forms a thin toner layer on its surface as it rotates. The developing sleeve 10*c* is disposed so as to hold a microscopic gap between itself and the photosensitive drum 7.

The developing sleeve 10*c* comprises a cylindrical aluminum member, the surface of which is toughened by sandblasting or the like treatment, and an electrically conductive coat in which pigment is dispersed. When the toner layer is formed on the surface of this developing sleeve 10*c*, the toner and developing sleeve 10*c* rub against each other, whereby a triboelectrical charge strong enough to develop the electrostatic latent image having been formed on the photosensitive drum 7 is generated. Further, the developing means comprises a developing blade 10*d* for regulating the thickness of the toner layer.

In addition, a stirring member for stirring the toner is provided within the toner storing container 10*a*, but the toner stirring mechanism will be described later.

(Cleaning means)

Referring to FIG. 3, the cleaning means 11 comprises: a cleaning blade 11*a* which is placed in contact with the surface of the photosensitive drum 7 to scrape the toner remaining on the drum 7: a scooping sheet 11*b* placed below the blade 11*a* gently in contact with the surface of the photosenisitive drum 7 to scoop the scraped toner: and a waste toner storage 11*c* for storing the scooped waste toner.

(Shutter member)

The shutter member 28 exposes or covers an opening 12*b*1 provided in the bottom frame member 12*b* of the process cartridge C. When the process cartridge C is mounted in the apparatus main assembly 16, it exposes the opening 12*b*1 so that the photosensitive drum 7 is exposed through the opening 12*b*1 (FIG. 1), and as the process cartridge C is taken out of the apparatus main assembly 16, it covers the opening 12*b*1 to cover the photosensitive drum 7 so that the photosensitive material on the peripheral surface of the photosensitize drum 7 is prevented from being deteriorated by exposure to light. It should be noted here that the opening 12*b*1 is provided to transfer the toner image formed on the peripheral surface of the photosensitive drum 7 onto the recording medium, as it is evident from FIG. 3.

The relation between the mechanism for opening or closing the shutter member 28 and the light transmitting window will be described later.

(Stirring means)

Figure 6:
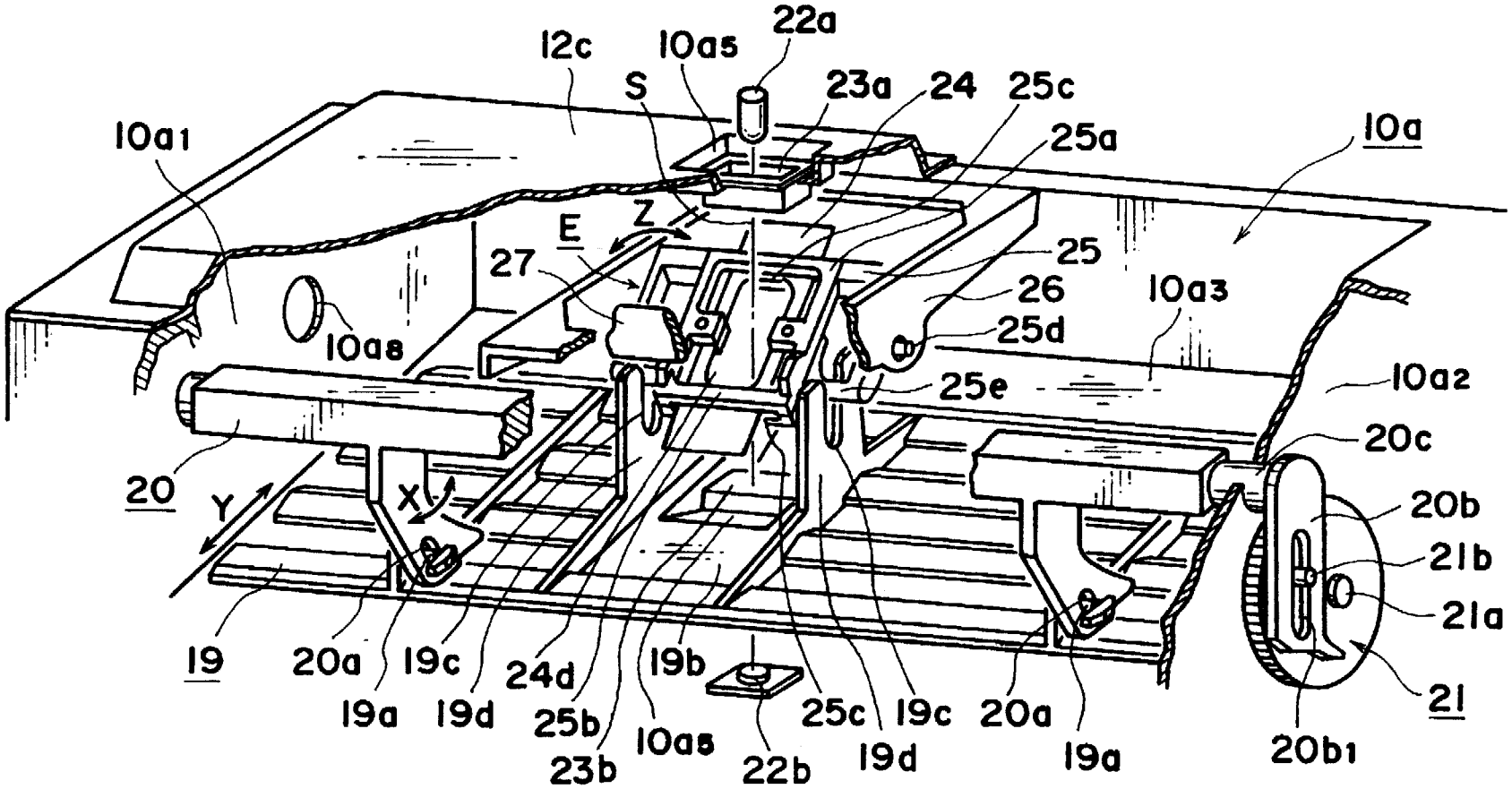
FIG. 6 is a perspective view of means for starring the toner, means for detecting the remaining toner, and means for cleaning, which are within a toner storing container, and illustrates their structures.

The stirring means stirs the toner within the toner storing container 10*a* and feeds it toward the developing sleeve 10*c*. Referring to FIG. 6, it comprises a stirring member 19 and a stirring arm 20, which are disposed within the toner storing container 10*a*.

The stirring mender 19 is made of a number of rod-like members having a triangular section, which are connected side by side with predetermined intervals. An axis 19*a* provided at one of the end portions of the stirring member 19 is fitted in a hole 20*a* of the stirring arm 20. The stirring member 19 has an opening 19*b* formed so as not to block a light path R of a remaining toner amount detecting means which will be described later, and on both sides of the opening 19*b*, a U-shaped rib 19*d* having a groove 19*c* is provided.

The rotational axis 20*c* of the stirring arm 20 is supported by lateral walls 10*a*1 and 10*a*2 of the toner storing container 10*a* so as to allow the rotation of the stirring arm 20 about the axis 20*c*, and a driving arm 20*b* is integrally formed at one end of the rotational axis 20*c* extending beyond the lateral wall 10*a*2 of the toner storing container 10*a*.

Outside the lateral wall 10*a*2 of the toner storing container 10*a*, a stirring gear 21 is placed, which rotates about a rotational axis 21*a* together with the photosensitive drum 7. On the lateral surface of this stirring gear 21, an eccentric projection 21*b* which is decentered from the rotational axis 21*a* is provided, and the eccentric projection 21*b* is fitted in an elongated hole 21*b*1 of the driving arm 20*b*.

As the photosensitive drum 7 is rotated, the stirring gear 21 is rotated by the same driving power source, and as the stirring gear 21 rotates, the stirring arm 20 is reciprocatively rotated in the direction of an arrow X in FIG. 6, about the rotational axis 20*c*, whereby the stirring member 19 is reciprocatively moved along the bottom wall 10*a*3 of the toner storing container 10*a*, in the direction of an arrow Y in FIG. 6, preventing thereby the toner from being aggregated or unevenly distributed.

The bottom wall 10*a*3 of the toner storing container 10*a* is slanted, with its developing sleeve 10*c* side being the lower side, so that the toner is easily conveyed toward the developing sleeve 10*c*, and as the stirring member 19 reciprocatively moves in the arrow Y direction along the bottom surface of the toner storing container 10*a*, the toner is fed toward the developing sleeve 10*c*.

(Remaining amount detecting means)

The remaining amount detecting means detects the remaining amount of the toner contained in the toner storing container 10*a*. As for its structure, it comprises, as illustrated in FIGS. 1, 3 and 6, a light emitting element 22*a* as light emitting means which is disposed on the internal surface of the top wall of the hinged movable cover 17, and a light receiving element 22*b* as light receiving means which is disposed on the apparatus main assembly 16, at a predetermined spot, which is where the light is projected from the light emitting element 22*a*. The light emitting element 22*a* and light receiving element 22*b* are disposed in such a manner that when the process cartridge C is installed in the apparatus main assembly 16 and the movable cover 17 is closed, they oppose each other, interposing between them the toner storing container 10*a* of the process cartridge C. In other words, they are disposed so as for the light emitting element 22*a* to be positioned above the process cartridge C having been installed in the apparatus main assembly 16, and for the light receiving element 22*b* to be positioned below the cartridge C.

Further, in the recessed portions 10*a*3 and 10*a*5 of the top and bottom walls of the toner storing container of the process cartridge C, light transmitting windows 10*a*6 and 10*a*7 are formed, in which a first light transmitting member 23*a* and a second light transmitting member 23*b* are fitted, respectively. The light from the light emitting element 22*a* is transmitted through the light transmitting members 23*a*, the internal space of the toner storing container 10*a*, and the light transmitting member 23*b*, to reach the light receiving element 23*b*. Therefore, when there is a sufficient amount of the toner within the toner storing container 10*a*, the light from the light emitting element 22*a* is blocked by the toner, being prevented from reaching the light receiving element 22*b*, but as the toner within the toner storing container 10*a* becomes depleted, that is, as the amount of the toner within the toner storing container 10*a* is decreased below a predetermined amount, the light from the light emitting element 22*a* is allowed to be transmitted through the toner storing container 10*a* to reach the light receiving element 22*b*. Thus, it is possible to detect whether or not the toner remains within the toner storing container 10*a*.

It should be noted that the term "light transmitting" means a capacity to transmit "the light emitted from the light emitting element 22*a*". Further, in FIG. 3, a referential character S designates an optical axis connecting the centers of the light emitting element 22*a* and light receiving element 22*b*, and R designates a light path for the light which is emitted from the light emitting element 22*a* and is detected by the light receiving element 22*b* as it reaches it.

(Cleaning means)

Next, the cleaning means will be described. It cleans the toner or the like adhering to the light transmitting members 23*a* and 23*b*, wherein the actual cleaning is carried through the wiping movement of a cleaning member E. The structure of this cleaning means will be described referring individually to (1) Cleaning structure, (2) Positional relation between the cleaning member, and light transmitting windows, (3) Stroke of the cleaning member, and (4) Fitting Structure for the light transmitting member.

(Cleaning structure)

Figure 7:
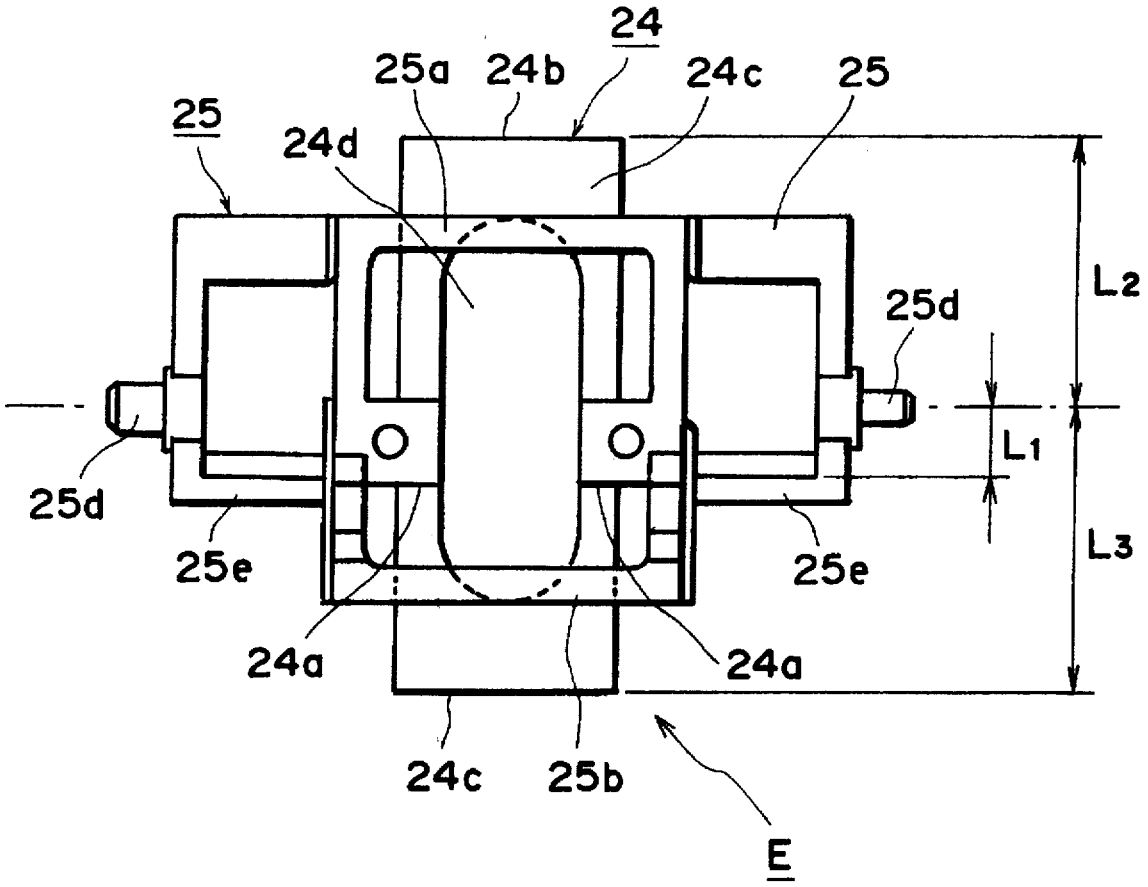
FIG. 7 is an explanatory plan view of a cleaning member.

The cleaning member E comprises, as illustrated in FIGS. 6 and 7, a flexible wiper blade 24 and a rigid wiper arm 25. The wiper blade 24 is a member formed of thin plate of polyethylene terephthalate (PET), being affixed to the wiper arm 25 by its center portion 24*a* and projecting outward at both ends beyond slits 25*b* and 25*c* provided at both edges 25*a* and 25*b* of the wiper arm 25.

The rotational axis 25*d* of the wiper arm 25 is supported by a bearing 26 so that the wiper arm 25 can be rotated about the rotational axis 25*d*. Further, the wiper arm 25 is provided with a driving axis 25*e* which is eccentrically disposed from the rotational axis 25*d*, and this driving axis 25*e* is fitted in the U-shaped groove 19*c* of the stirring member 19.

Therefore, as the stirring member 19 is reciprocated in the arrow Y direction in FIG. 6 as described before, the driving axis 25*e* receives a force from the rib 19*d* of the stirring member 19, thereby rotating reciprocatively the cleaning member E about the rotational axis 25*d* in the direction of an arrow Z in FIG. 6. As a result, the edges 24*b* and 24*c* of the wiper blade 24 are rotatively oscillated across the light transmitting member 23*a* and 23*b* fitted in the light transmitting windows 10*a*6 and 10*a*7, being in contact with their internal surfaces and thereby, cleaning them, respectively. Since in this embodiment, the cleaning member E is caused to wipe by the movement of the stirring member 19, it is unnecessary to provide a separate driving power source to drive the cleaning member E; therefore, the apparatus structure can be simplified to reduce the cost.

Further, the wiper blade 24 is provided with an opening 24*d* so that the light, from the light emitting element 22*a* is not blocked. Therefore, even when the rotational axis 25*d* is disposed in such a manner that the extension of the rotational axis 25*d* might block the optical axis S, it is only when the edges 25*a* and 25*b* of the wiper arm 25, and the wiper blade 24 cross the optical path R that the light path R is blocked, and the presence or absence of the toner can be detected while the edges 25*a* and 25*b*, and the wiper blade 24, are not blocking the light path R.

(Positional relation between cleaning member and light transmitting window or the like)

Figure 8:
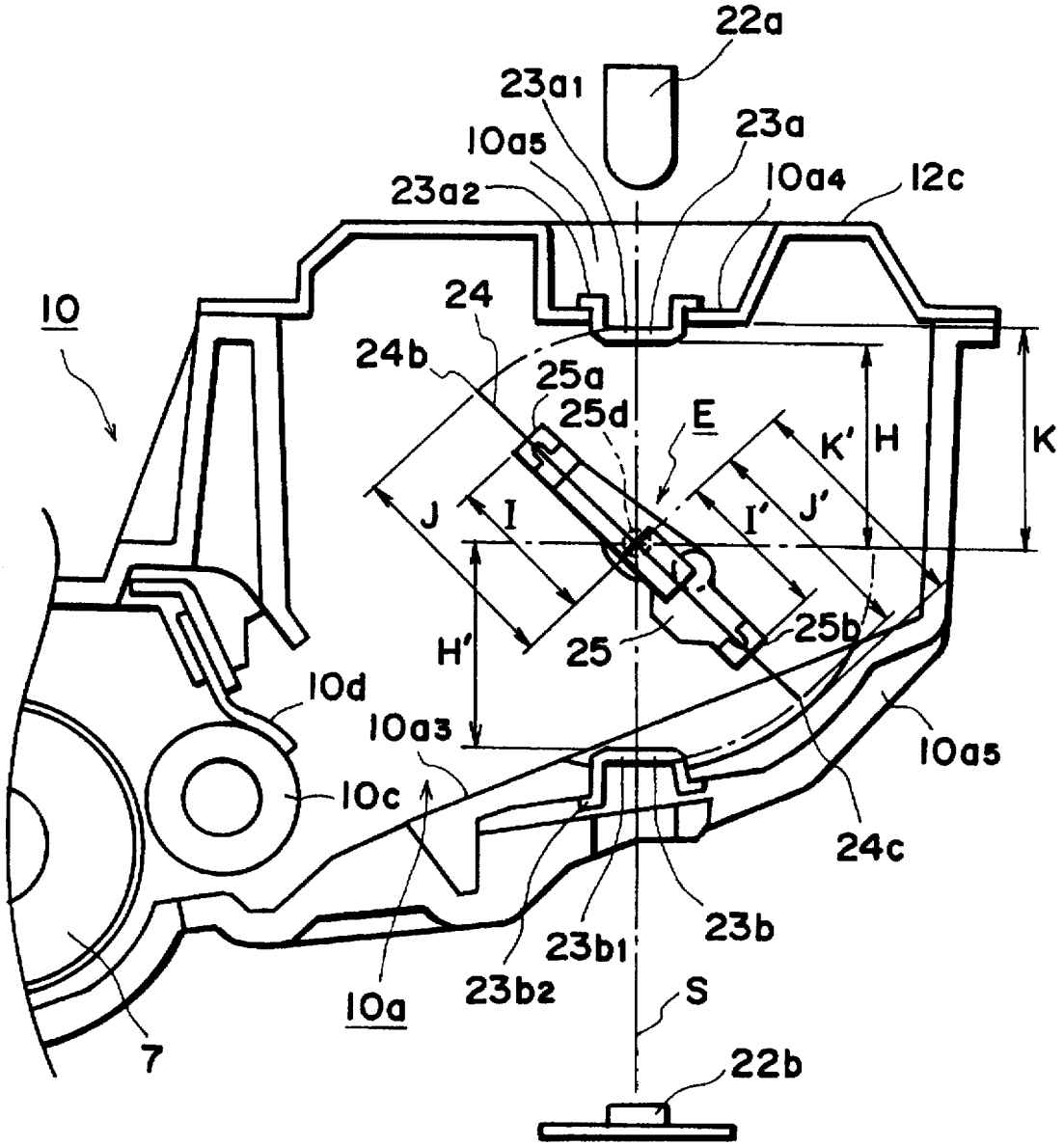
FIG. 8 is an explanatory view of the cleaning member and a light transmitting window, showing their longitudinal relation.

Next, the positional relation among the cleaning member E, light emitting element 22*a*, light receiving element 22*b*, and light transmitting windows 10*a*6 and 10*a*7 will be described with reference to FIG. 8.

As stated before, the process cartridge is mounted in the apparatus main assembly 16 so that the light emitting element 22*a* and light receiving element 22*b* oppose each other, interposing the toner storing container 10*a* between rhea when the movable cover 17 is closed. Also, the rotational axis 15*d* of the cleaning member E is disposed near the optical axis S.

The light transmitting windows 10*a*6 and 10*a*7 are disposed to as to correspond to the light emitting element 22*a* add light receiving element 22*b*, respectively, and the light transmitting members 23*a* and 23*b* are formed in such a manner that the curvatures of their internal surfaces match that of a circle sharing the center of the rotational axis 25*d* as its center.

Therefore, the angle between the light transmitting members 23*a* and 23*b* and the optical axis S is extremely close to a right angle, which allows the sizes of the light transmitting members 23*a* and 23*b* to be reduced to a far smaller size compared to when the light transmitting members 23*a* and 23*b* are not placed perpendicular to the optical axis S. As a result, the image deterioration, photosensitive drum 7 deterioration, or toner deterioration which is caused by the intrusion of stray light surface of the light transmitting member 23*a* on the top side.

I: distance between the rotational axis 25*d* and the top edge 25*a* of the wiper arm 25, J: distance between the rotational axis 25*d* and the top edge 24*b* of the wiper blade 24, and K: distance between the rotational axis 25*d* and the internal surface of the top wall of the toner storing container 10*a*, the positional relation among the cleaning member, the light transmitting windows, and the related components satisfies the following formula:

$$I<H<J<K.$$

Similarly, when the distance between the various portions of the bottom side of the cleaning member E and the light transmitting member 23*b* on the bottom side or the related members are designated as follows:

H': distance between the rotational axis 25*d* and the internal surface of the light transmitting member 23*b* on the bottom side, I': distance between the rotational axis 25*d* and the bottom edge 25*b* of the wiper arm 25, J': distance between the rotational axis 25*d* and the bottom edge 24*c* of the wiper blade 24, and K': distance between the rotational axis 25*d* and the internal surface of the recessed portion 10*a*5 of the bottom wall of the toner storing container 10*a*, the positional relation among the cleaning member, the light transmitting windows, and the related components, satisfies the following formula:

$$I'<H'<J'<K'.$$

When the cleaning member E is reciprocatively rotated with the above described structure in place, the edges 24*b* and 24*c* of the wiper blade 24 are reciprocatively rotated in contact with the internal surface of the light transmitting members 23*a* and 23*b*, wiping thereby the toner adhering to the internal surfaces of the members 23*a* and 23*b*.

When the wiper blade 24, which is an elastically deformable elastic member, is away from the light transmitting members 23*a* and 23*b*, the flex of the wiper blade 24 is gone.

Therefore, the direction of the flex of the wiper blade 24 reverses between when the wiper blade 24 is rotated in one direction in contact with the light transmitting members 23*a* and 23*b* and when it is rotated in the other direction. As a result, the wiper blade 24 cleans the light transmitting members 23*a* and 23*b* while flexing always in the direction opposite to the rotational direction of the wiper blade 24. This allows the light transmitting members 23*a* and 23*b* to be cleaned under the same conditions whether the wiper blade 24 moves in one direction or the other.

As described hereinbefore, the cleaning member E is reciprocatively rotated in response to the image forming operation, and the wiper blade 24 wipes the toner adhering to the internal surface of the light transmitting members 23*a* and 23*b*. However, when here is a sufficient amount of the toner, the toner immediately covers the light transmitting members 23*a* and 23*b* even though the wiper blade 24 wipes the toner on the internal surfaces of the members 23*a* and 23*b*; therefore, the light from the light emitting member 22*a* is blocked by the toner, failing thereby to reach the light receiving element 22*b*, or being blocked again shortly even when it reaches it.

However, as the remaining amount of the toner is further reduced, the time is takes for the toner to cover the light transmitting members 23*a* and 23*b* after the cleaning thereof becomes longer, and as the toner eventually runs out, that is, when the amount of the toner drops below a predetermined amount, the light from the light emitting element 22*a* comes to reach the light receiving element 22*b* except when the edges 25*a* and 25*b* of the wiper arm 25 and the wiper blade 24 are crossing the light path R.

Figure 9:
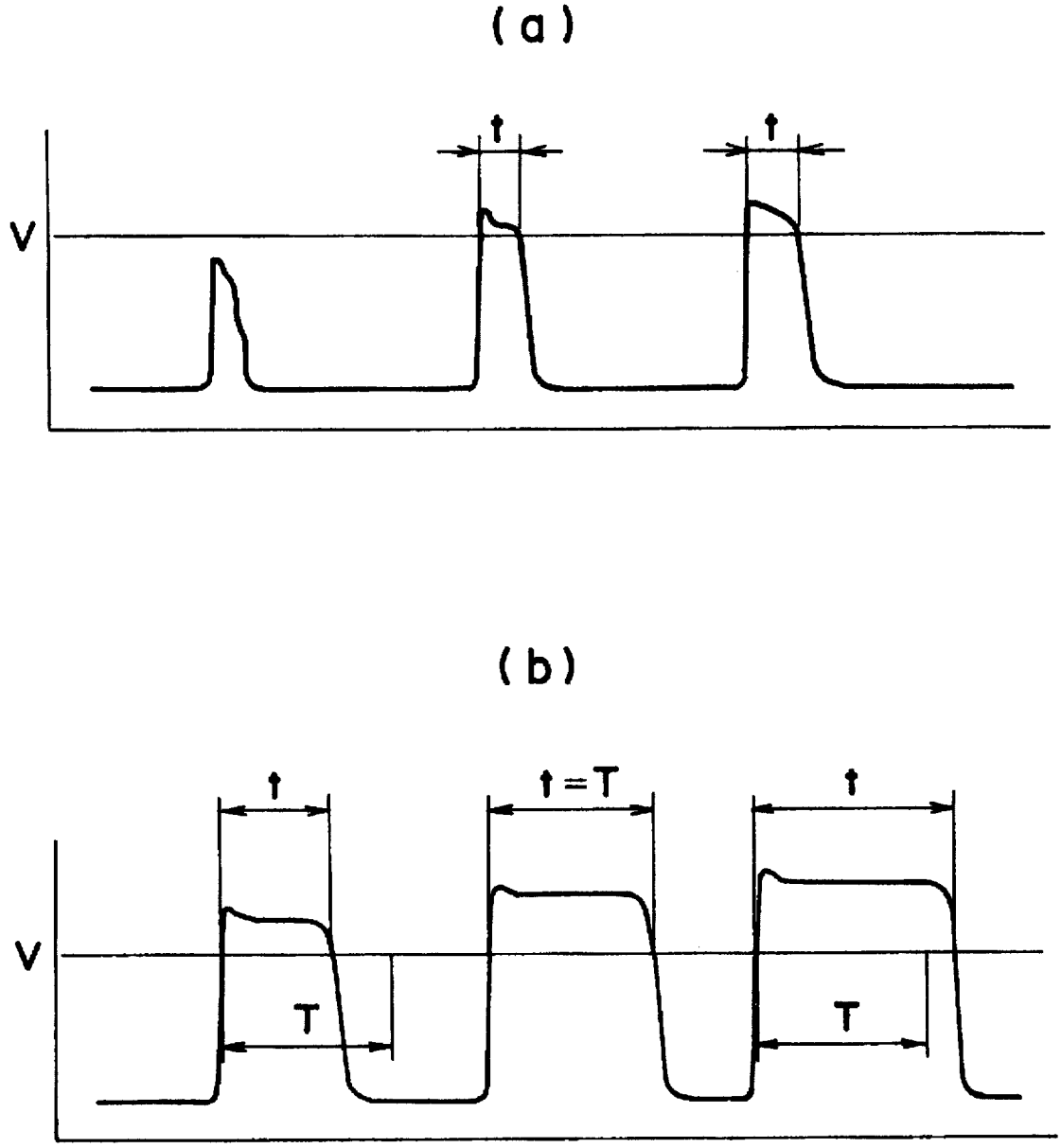
FIG. 9 is an explanatory drawing to describe the relation between the presence or absence of the toner, and the output of a light receiving element.

FIG. 9 presents graphs in which the signal output value of the light receiving element 22*b* during the aforementioned detecting period is plotted on the ordinate and the time is plotted on the abcissa. As is evident from these graphs, when the light from the light emitting element 22*a* reaches the light receiving element 22*b*, the output value of the light receiving element 22*b* increases. Therefore, the output signal from the light receiving element 22*b* alternates between a high output value which is given when the light reaches the light receiving element 22*b*, and a low output value which is given when the light is blocked. In other words, the graph of the signal output forms a saw tooth shape.

While a sufficient amount of the toner is in the aforementioned toner storing container 10*a*, the duration of the higher output signal is short, and also, its output value is small, as shown in FIG. 9(*a*), but as the amount of the toner becomes smaller, the duration of the higher output signal becomes longer, and also, the output value increases, as shown in FIG. 9(*b*). Therefore, when the duration t of the output signal having an output value higher than a predetermined value V exceeds a predetermined duration T, a control portion 29, which will be described later, determines that the toner has been depleted.

(Stroke of cleaning member)

Figure 10:
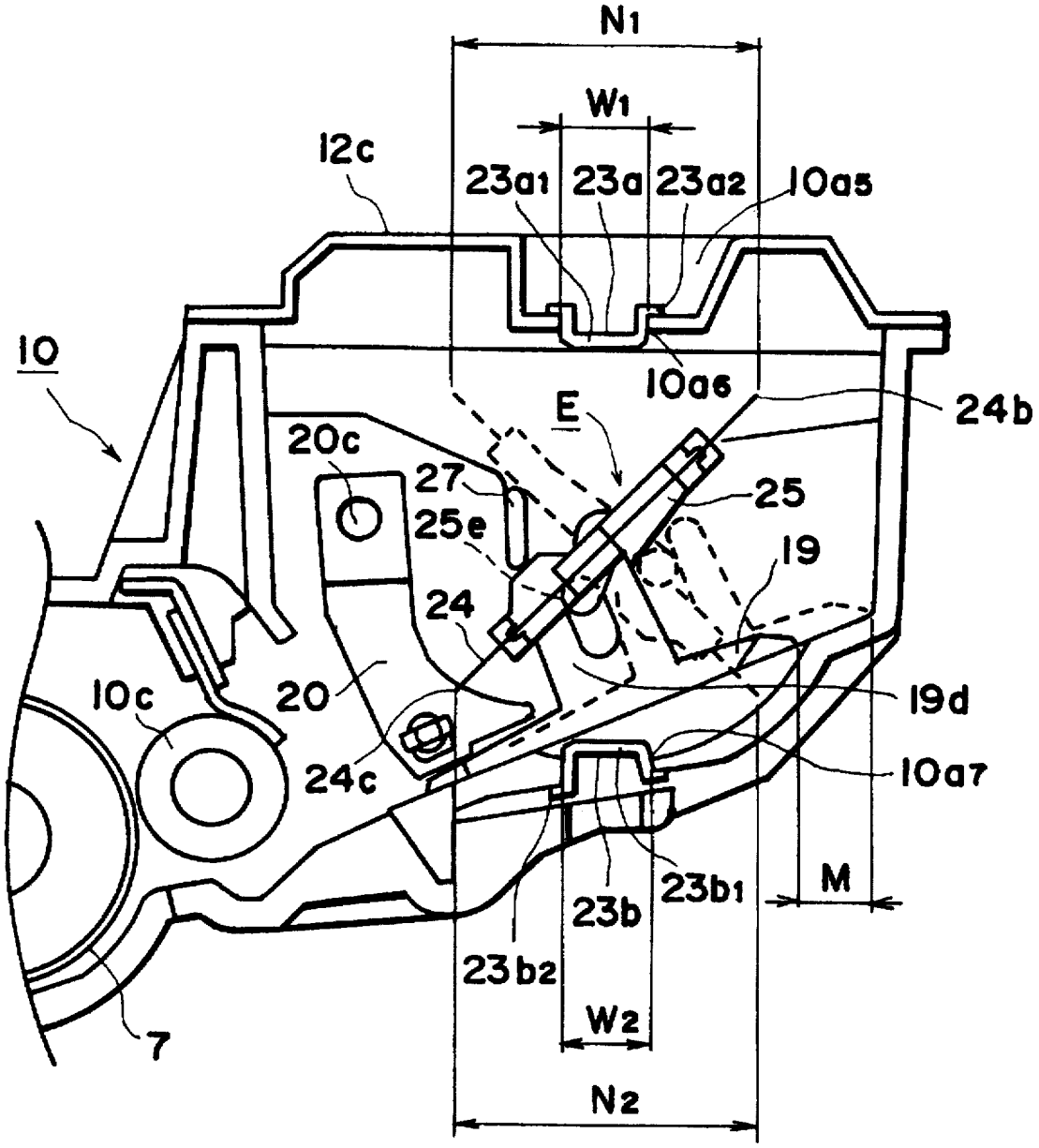
FIG. 10 is an explanatory drawing to describe the positional relation between the cleaning member and light transmitting window.

Next, the rotational stroke of the cleaning member E will be described. FIG. 10 is an explanatory drawing to compare the reciprocating range of the cleaning member E and the cleaning range of the wiper blade 24 with the sizes of the light transmitting members 23*a* and 23*b*.

In FIGS. 7 and 10, the cleaning member E is constructed in such a manner that a distance L1 between the rotational axis 25*d* and driving axis 25*e* becomes smaller than a distance L2 between the rotational axis 25*d* and the top edge 24*b* of the wiper blade 24 and a distance L3 between the rotational axis 25*d* and the bottom edge 24*c* of the wiper blade 24. Therefore, when the stirring member 19 moves by a distance M, the driving axis 25*e* of the cleaning member E moves the same distance M as the stirring member 19. Meanwhile, the top and bottom edges 24*b* and 24*c* of the wiper blade 24 move $$N1=(L2/L1)\times M,$$

and $$N2=(L3/L1)\times M,$$

respectively.

When the distance L1 between the rotational axis 25*d* of the cleaning member E and the driving axis 25*e* satisfies the following formula:

$$L1\leqq(M\times L2)/W1,$$

and $$L1\leqq(M\times L3)/W2,$$

wherein the size of the light transmitting window 10*a*6 on the top side is W1, and the size of the light transmitting window 10*a*7 on the bottom side is W2, the amounts N1 and N2 of the movements of the edges 24*b* and 24*c* of the wiper blade 24 become larger than the sizes W1 and W2 of the light transmitting windows 10*a*6 and 10*a*7, respectively; therefore, the light transmitting members 23*a* and 23*b* can be completely cleaned.

When the above described structure is employed, the stroke of the wiper blade 24 can be made to be large even when the moving distance of the stirring member 19 is reduced. As a result, the stirring member 19 can afford a moving distance satisfactory to stir optimally the toner, and the cleaning member E can afford a stroke satisfactory to clean the light transmitting members 23*a* and 23*b*. Thus, the presence or absence of the toner can be highly precisely detected without deteriorating the image quality.

The reciprocative rotational angle of the cleaning member E is selected based on the material for the driving axis 25*e* and the rib 19*d* of the stirring member 19, so that the driving axis 25*e* and rib 19*d* are allowed to slide smoothly against each other. In this embodiment, ABS resin is used as the material for the driving axis 25*e* and rib 19*d*, and the reciprocative rotational angle is selected to be no more than 140 degrees.

Figure 11A:
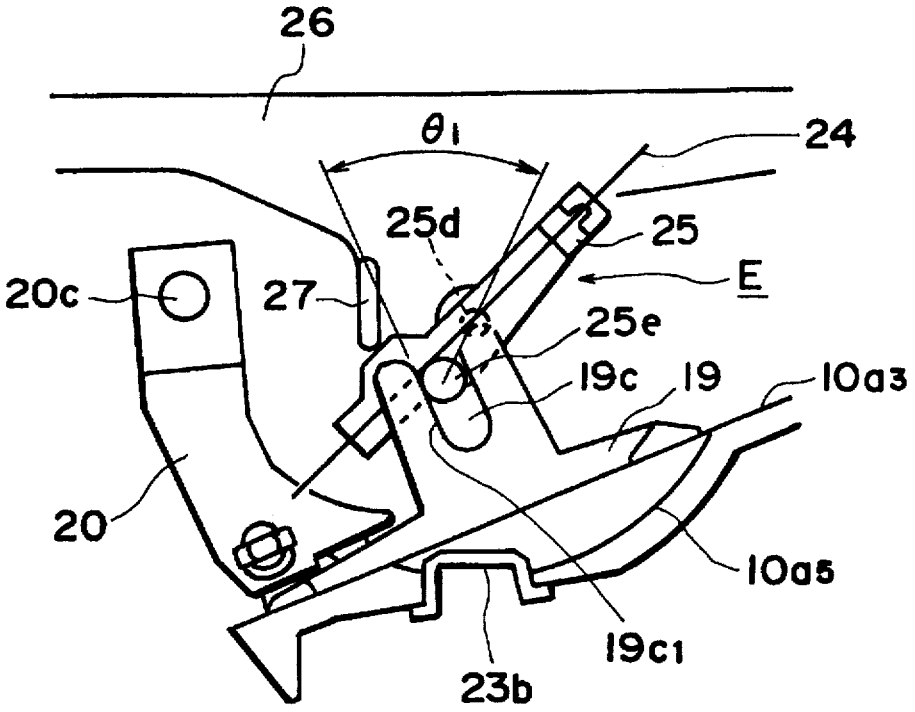
FIGS. 11A and 11B are explanatory drawings to describe the relation between the rotational angle of the cleaning member, and a stopper.
Figure 11B:
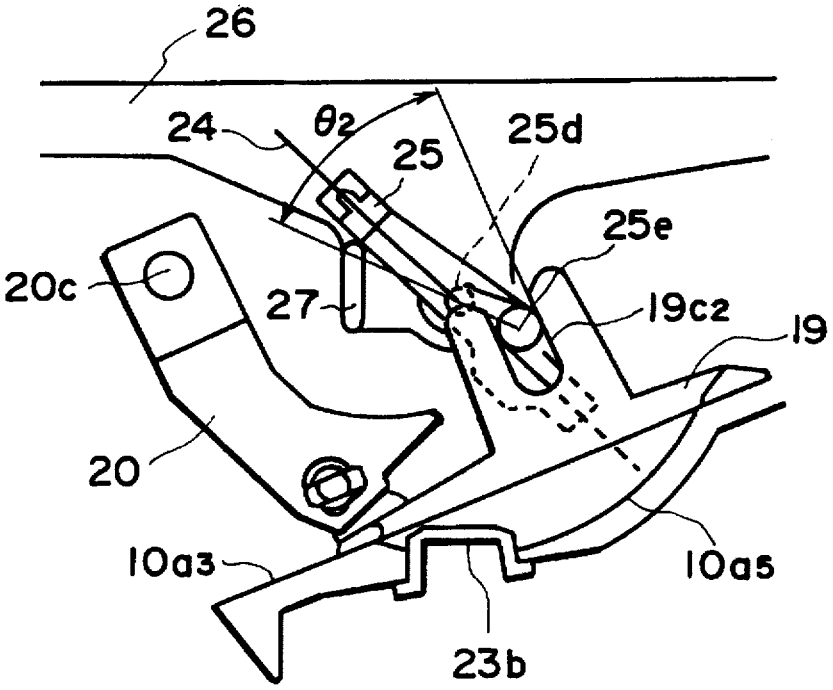

Therefore, a stopper 27 is provided for preventing the cleaning member E from rotating more than a predetermined angle. This stopper 27 is integrally formed on the bearing 26 to which the rotational axis 25*d* is fitted, as shown in FIG. 11.

In this embodiment, the stirring arm 20 and the stirring member 19 are fitted with some play so that the movements of the stirring am 20 and stirring member 19 are not interfered with by the toner stuck in the joint portion. The U-shaped groove of the stirring member 19 and the driving axis 25*e* of the cleaning member E are also fitted with some play because of the name reason. Therefore, the moment the edges of the wiper blade 24 separate from the light transmitting members 23*a* and 23*b* after the flexed wiper blade 24 cleans the light transmitting members 23*a* and 23*b*, the resiliency of the wiper blade 24 is liable to cause the cleaning member E to jump, which is liable to prevent the smooth operation of the cleaning member E.

Therefore, in this embodiment, the stopper 27 is specifically located so that angles θ1 and θ2 formed between the straight line connecting the rotational axis 25*d* of the cleaning member E and the driving axis 25*e*, and the sliding surfaces 19*c*1 and 19*c*2 of the U-shaped groove 19*c* become such angles as to allow the driving axis 25*e* and U-shaped groove 19*c* to slide smoothly against each other.

When such an arrangement is made, the cleaning member E contacts the stopper 27, being prevented from rotating more than the predetermined angle, even if the cleaning member E is caused to jump by the resiliency of the wiper blade 24. As a result, the cleaning member E smoothly rotates back and forth. It should be noted that in this embodiment, the angles θ1 and θ2 are selected to be no more than 70 degrees, respectively.

Also, in this embodiment, since the stopper 27 is integrally formed on the bearing 26 of the cleaning member E, the positional relation between the stopper 27 and cleaning member E can be precisely fixed while using a simple structure. Therefore, the rotational angles θ1 and θ2 of the cleaning member E can be precisely maintained, which allows the driving axis 25*e* of the cleaning member E and the U-shaped groove 19*c* of the stirring member 19 to slide smoothly against each other.

Further in this embodiment, the recessed portion 10*a*5 is provided in the bottom wall 10*a*3 of the toner storing container 10*a*, to prevent the bottom edge 24*c* of the wiper blade 24 from contacting the bottom surface of the toner storing container 10*a*. Besides, the light transmitting window 10*a*7 is provided at the deepest point of the recessed portion 10*a*5, and the light transmitting member 23*b* is attached so that its internal surface comes to be located above the bottom surface of the recessed portion 10*a*5 and below the bottom wall surface 10*a*3 of the toner storing container 10*a*.

In this embodiment, the positioning and angle of the bottom wall 10*a*3 of the toner storing container 10*a* is determined so as to match the toner to be used, so that the toner can be optimally stirred and fed toward the developing sleeve 10*c*.

On the other hand, there are two methods for increasing the stroke of the cleaning member E; it is necessary either to increase the rotational angle of the cleaning member E by shortening the distance L1 between the rotational axis 25*d* of the cleaning member E and the driving axis 25*e*, or to increase the distances L2 and L3 between the rotational axis 25*d* of the cleaning member E and the edges 24*b* and 24*c* of the wiper blade 24.

However, in the case of the former method, even a small change in the stroke of the stirring member 19 causes the rotational angle of the cleaning member E to change greatly. Therefore, in order to secure a large enough stroke of the cleaning member E to clean the light transmitting members 23*a* and 23*b* while allowing the smooth sliding of the driving axis 25*e* end U-shaped groove 19*c* upon each other, it is necessary to maintain accurately the stroke of the stirring member 19, which causes the apparatus cost to be relatively high since the apparatus must be more precisely constructed.

In the case of the latter method, it is necessary to increase the distance between the internal surfaces of the light transmitting members 23*a* and 23*b*. Since the light transmitting windows 10*a*6 and 10*a*7 of this embodiment are disposed at the top and bottom of the toner storing container 10*a*, respectively, positioning of the top light transmitting window 10*a*6 at a higher location requires both the rotational axis 25*d* and driving axis 25*c* of the cleaning member E to be positioned higher, and also, the U-shaped groove 19*c* of the stirring member 19 must be located higher. When such an arrangement is made, it is liable that the rotational moment which is imparted to the stirring member 19 by the resistance generated as the cleaning member E is driven becomes excessively large.

Therefore, in this embodiment, the recessed portion 10*a*5 is provided at a portion of the bottom wall 10*a*3 of the toner storing container 10*a*, and the bottom light transmitting member 23*b* is placed in the recessed portion 10*a*5, so that a large distance can be secured between the internal surfaces of the top and bottom light transmitting members 23*a* and 23*b*. This arrangement positions the rotational axis 25*d* and driving axis 25*e* of the cleaning member E closer to he bottom wall 10*a*3 of the toner storing container 10*a*. As a result, the rotational moment which is imparted to the stirring member 19 by the resistance generated as the cleaning member E is driven can be kept smaller, preventing thereby the reciprocative movement of the stirring member 19 along the bottom wall 10*a*3 surface of the toner storing container 10*a* from being interfered with.

Further, this embodiment is structured so that the internal surface of the bottom light transmitting member 23*b* is positioned below the bottom wall 10*a*3 of the toner storing container 10*a* around the recessed portion 10*a*5. Therefore, as long as a sufficient amount of the toner is in the surrounding area of the recessed portion 10*a*5, the toner pours into the recessed portion 10*a*5 and covers the light transmitting member 23*b*. As a result, it is not liable that it is determined that the toner has been depleted in spite of the presence of a sufficient amount of the toner. This effectively increases accuracy in detecting the presence or absence of the toner.

Further, since the recessed portion 10*a*5 is not given the shape which slopes down toward the developing sleeve 10*c*, the toner feeding performance of the stirring member 19 is liable to become less efficient in this portion than in the other portions. However, this deficiency is compensated by the reciprocative rotation of the cleaning member E synchronous with the reciprocative movement of the stirring member 19, and as a result, the overall toner feeding efficiency of this portion becomes uniform with the other portions.

(Attachment structure of light transmitting member)

Next, the structure for attaching the light transmitting members 23*a* and 23*b* to the light transmitting windows 10*a*6 and 10*a*7 will be described.

In this embodiment, in order to produce inexpensively the process cartridge C, polystyrene resin (PS) is used as the material for the frame members 12*a* and 12*b* which make up the toner storing container 10*a*, and also, the toner ingredients include styrene resin. On the other hand, polycarbonate (PC) is used as the material for the light transmitting members 23*a* and 23*b*, and polyethylene terephthalete (PET) is used as the material for the wider blade 24. It has been confirmed through experiments that the efficiency with which the light transmitting members 23*a* and 23*b* are cleaned can be preferably maintained by the combined use of these materials.

However, when the light transmitting members 23*a* and 23*b* of polycarbonate are attached to the toner storing container 10*a* of polystyrene, sufficient strength cannot be obtained with the use of such a method as welding since the molecular structures of both materials are different, and as a result, the light transmitting members 23*a* and 23*b* are liable to be separated from the toner storing container 10*a*.

On the other hand, if the polystyrene resin is chosen as the material for the light transmitting members 23*a* and 23*b*, the aforementioned members 23*a* and 23*b* can be attached to the toner storing container 10*a* using a simple method such as welding or the like, but the toner containing the styrene resin is liable to adhere to the light transmitting members 23*a* and 23*b*, which presents such a liability that the wiper blade 24 made of polyethylene terephthalate cannot offer sufficient cleaning performance.

Therefore, in this embodiment, the light transmitting members 23*a* and 23*b* are constituted of light transmitting portions 23*a*1 and 23*b*1 of polycarbonate and flange portions 23*a*2 and 23*b*2 of polystyrene resin, which is the same material as that of the toner storing container 10*a*, respectively. The light transmitting portions 23*a*1 and 23*b*1 and the flange portions 23*a*2 and 23*b*2 are integrally formed with the use of the two-color injection molding method. The interface between the light transmitting portions 23*a*1 and 23*b*1 and the flange portions 23*a*2 and 23*b*2, respectively, are given an undercut shape to present the flange portions 23*a*2 and 23*b*2 from coming off the light transmitting portions 23*a*1 and 23*a*2.

It should be noted here that when forming the above described members and portions, it is preferable to use the insert molding method among various two-color molding methods because they can be more easily molded by this method.

In this case, the light transmitting members 23*a* and 23*b* are attached to the toner storing container 10*a* by welding the flanges 23*a*2 and 23*b*2 to the light transmitting windows 10*a*6 and 10*a*7.

When the materials and molding methods described above are used, the light transmitting members 23*a*1 and 23*b*1 made of the material different from that of the toner storing container 10*a* can be easily and inexpensively attached to the toner storing container 10*a*, and also, since there is no gap at the interfaces 23*a*3 and 23*b*3 because of the insert molding method, the toner is not liable to leak between the light transmitting portions 23*a*1 and 23*b*1 and the flange portions 23*a*2 and 23*b*2. Further, it becomes unnecessary to apply coating on the surface of the light transmitting portions 23*a*1 and 23*b*1, and therefore, their durability is also improved.

Though in this embodiment, the flange portions 23*a*2 and 23*b*2 are formed around the light transmitting portions 23*a*1 and 23*b*1 using the two-color molding method, the light transmitting portions 23*a*1 and 23*b*1 having the undercut shape may be directly formed into the light transmitting windows 10*a*6 and 10*a*7 with the use of the two-color injection molding method, which can provide the same beneficial effects as described above.

(Assembly of process cartridge)

Next, the assembly steps for the process cartridge C comprising the aforementioned stirring mean, cleaning means, and the like, will be described.

To begin with, the flange portion 23*a*2 of the top light transmitting member 23*a* is attached to the top light transmitting window 10*a*6 of the top frame member 12*a* by the ultrasonic welding, and in the same manner, the flange portion 23*b*2 of the bottom light transmitting member 23*b* is attached to the bottom light transmitting window 10*a*7 by the ultrasonic welding. As for the welding method, other welding methods such as high frequency welding or the like are also available, but the ultrasonic welding is simpler in this case.

In order to assemble the stirring member 19, cleaning member E and the like into the toner storing container 10*a*, the top wall 10*a*4 is formed as a cover member 12*c*, which is a piece separate from the main structure of the toner storing container 10*a*, and the top light transmitting member 23*a* is attached to this cover member 12*c*.

Next, the axis 19*a* of the stirring member 19 is fitted into the hole 20*b*1 of the stirring arm 20 to connect them, and the rotational axis 20*c* of the stirring arm 20 is rotatably attached to the toner storing container 10*a*. Then, the cleaning member E comprising the wiper arm 25 and the wiper blade 24 attached thereon is rotatably fitted in the bearing 26, and the driving axis 25*e* of the wiper arm 25 is fitted into the U-shaped groove 19*c* of the stirring member 19. Then, the bearing 26 is fixed to the toner storing container 10*a*.

The toner member 12*c* is welded to the main structure of the toner storing container 10*a*, finishing assembly of the toner storing container 10*a* containing the stirring member 19 and cleaning member E.

The charging roller B is attached to the interior surface of the top wall of the top frame member 12*a*. The toner is filled through the toner filling opening 10*a*8 (FIG. 6) provided in the lateral wall 10*a*1 of the toner storing container 10*a*, and then, the opening 10*a*8 is sealed with a cap.

Next, the photosensitive drum 7 is mounted in the bottom frame member 12*b*, and next, members such as developing sleeve 10*c* and development blade 10*d* which constitute the developing means are mounted. Then, the cleaning blade 11*a* or the like is attached.

Various projections and correspondent holes (not illustrated) engageable with the projections are provided at predetermined locations on the top and bottom frame members 12*a* and 12*b*, and the top and bottom frame members 12*a* and 12*b*, in which aforementioned various members have been mounted, are joined by means of engaging the projections with the correspondent holes. Lastly, the shutter member 28 is attached to finish assembling the process cartridge C.

(Relation between opening or closing movement of shutter member and light transmitting windows)

Figure 13:
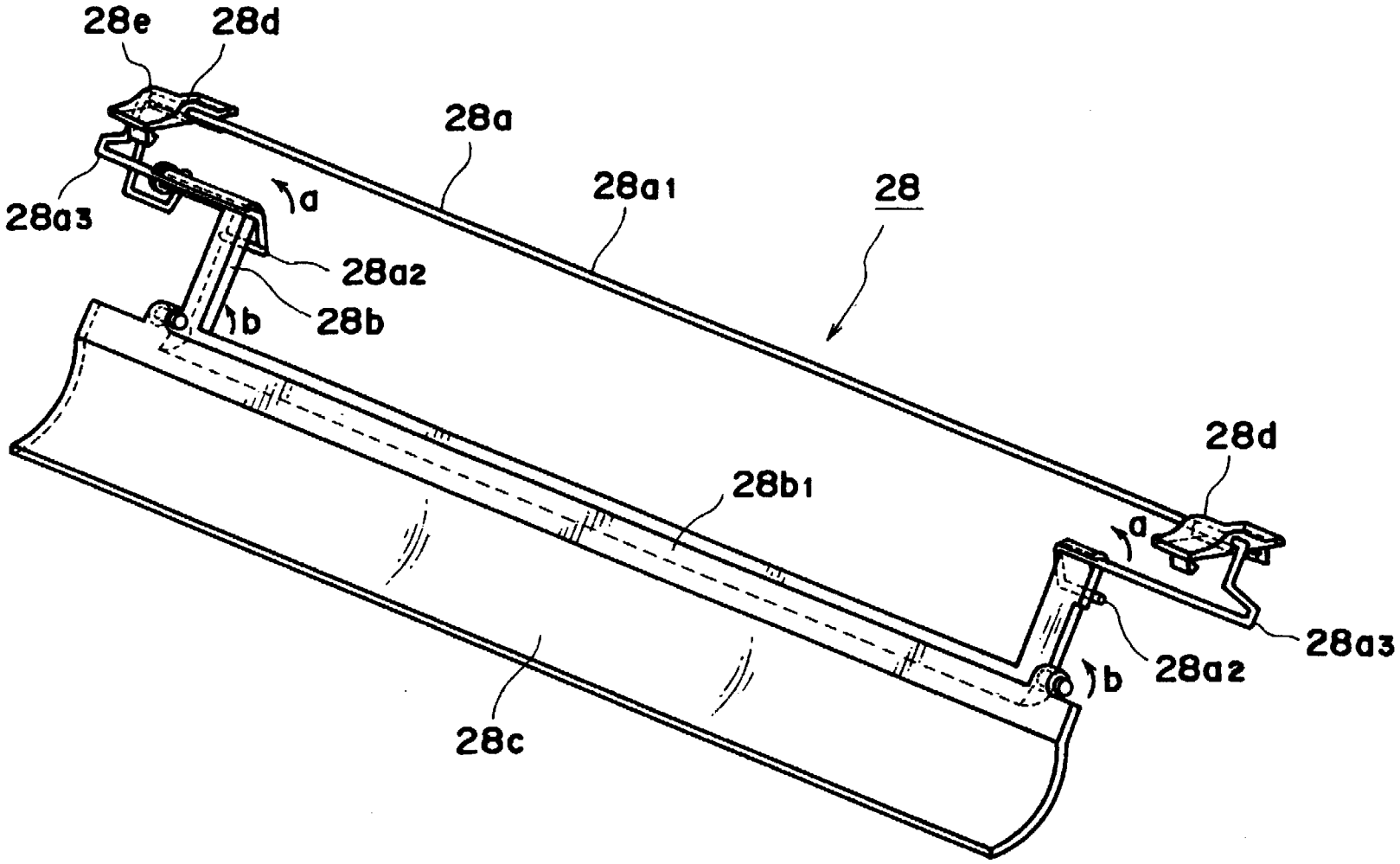
FIG. 13 is an explanatory perspective view of a shutter member.

The shutter member 28 protects the photosensitive drum 7. At This time, the structure for opening or closing the shutter member 28 will be described. Referring to FIG. 13, the shutter member 28 comprises a shutter arm 28*a*, a shutter linkage 28*b*, a shutter portion 28*c*, an axis retainer 28*d*, and a torsion coil spring 28*e*. As shown in the drawing, the shutter member 28 covers the transfer region through which the toner image formed on the peripheral surface of the photosensitive drum 7 is transferred onto the recording medium.

Each end portion of the shutter arm 28*a* is rotatably retained by the axis retainer 28*d*, at a point close to the end, and a shutter linkage 28*b* is rotatably supported on this shutter arm 28*a*, wherein the rotational movement of the shutter linkage 28*b* is regulated by a rotation regulating portion 28*a*2 of the shutter arm 28*a* so that it rotates no more than a predetermined angle in the direction of an arrow a in FIG. 13. The shutter portion 28*c* is rotatably supported on the shutter linkage 28*b*, and also, the rotational movement of this shutter portion 28*c* is regulated by a rotation regulating portion 28*b*1 of the shutter linkage 28*b* so that it rotates no more than a predetermined angle in the direction of an arrow b in FIG. 13.

At one of the longitudinal ends of the shutter arm 28*a*, the torsion coil spring is anchored to urge the shutter portion 28*c* in the direction to close the opening portion 12*b*1 of the bottom frame member 12*b*. Further, at both of the longitudinal ends of the shutter arm 28*a*, a projection 28*a*3 projecting outward is formed (FIG. 4). When the process cartridge C is installed into the apparatus main assembly 16, this projection 28*a*3 has a function to engage with a predetermined point of the apparatus main assembly 16 to open the shutter member 28.

As for the attachment of the shutter member 28, the axis portion 28a1 of the shutter arm 28a is dropped into the groove portion 12c1 of the cover member 12c, and then, the axis retainer 28d is anchored to the top frame member 12a while anchoring the torsion coil spring 28e at the same time, as illustrated in FIG. 4.

Figure 14:
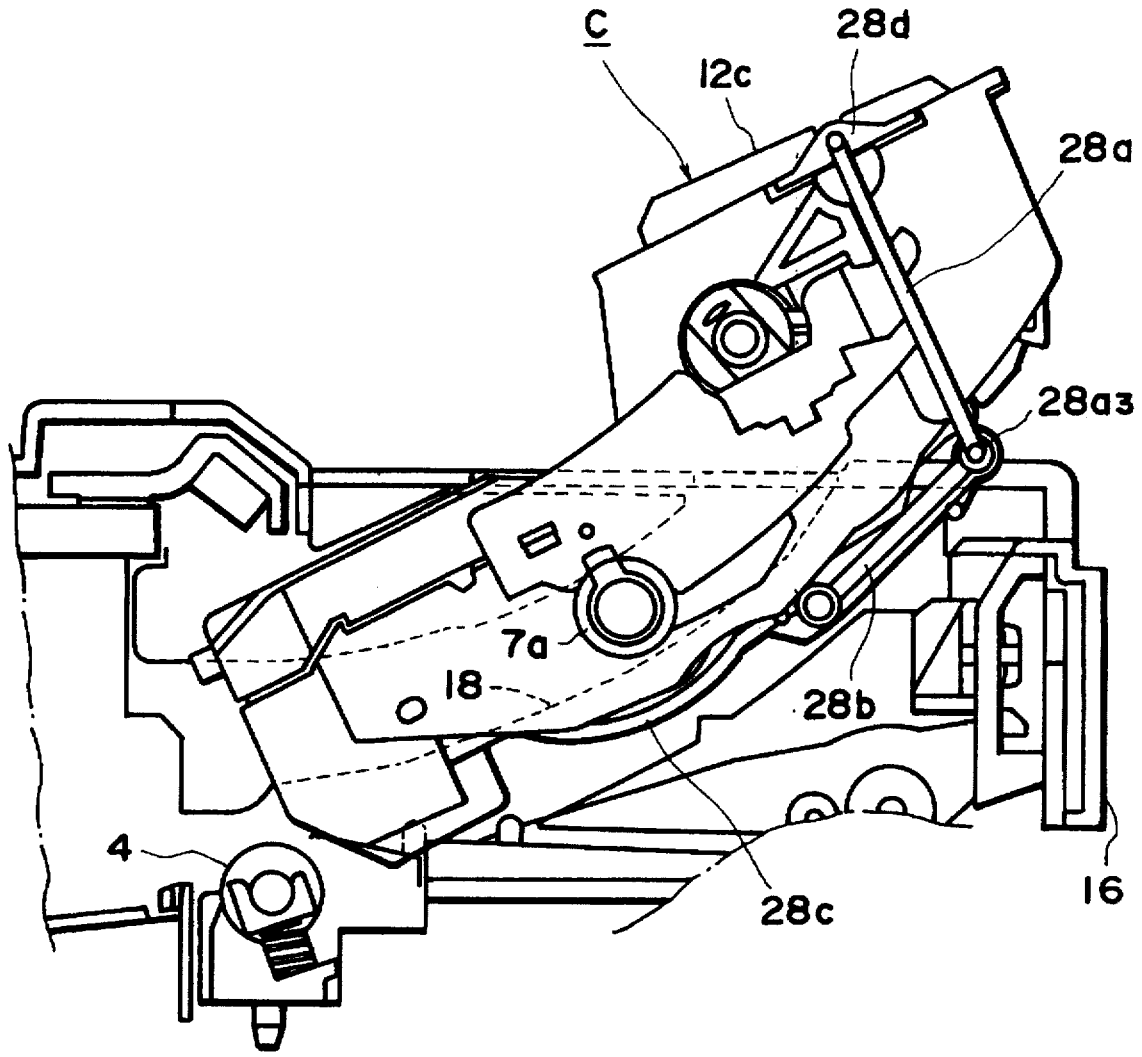
FIG. 14 is an explanatory drawing to describe how the shutter member is opened when the process cartridge is inserted into the main assembly of an image forming apparatus.
Figure 15:
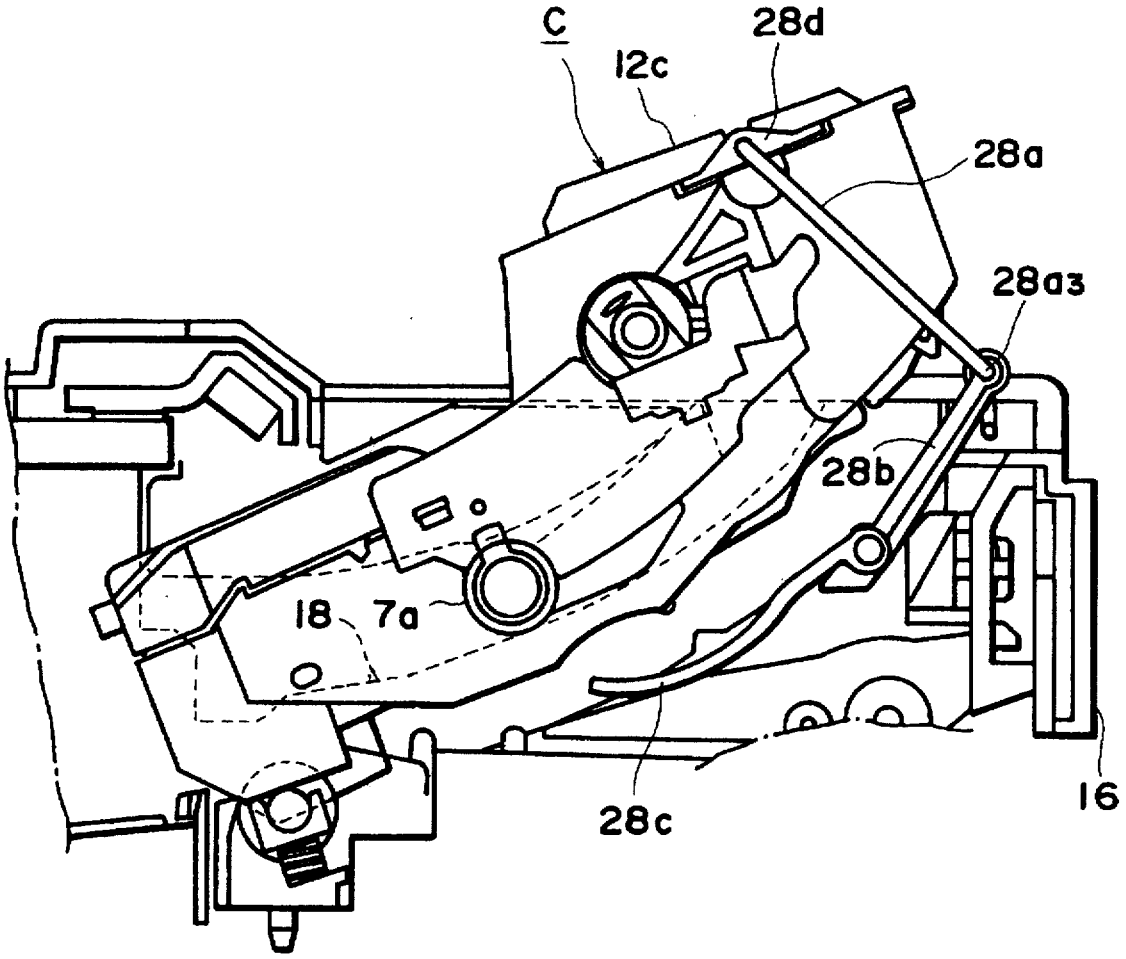
FIG. 15 is an explanatory drawing To describe how the shutter member is opened when the process cartridge is inserted into the main assembly of an image forming apparatus.

Before the process cartridge C is installed into the apparatus main assembly 16, the shutter member 28 is covering the opening portion 12b1 due to the pressure from the torsion coil spring 28e. As the process cartridge C is gradually inserted into the apparatus main assembly 16, the projection 28a3 comes to contact the upper surface portion of the apparatus main assembly 16 as shown in FIG. 14. As the process cartridge C is further inserted from this state, the shutter arm 28a rotates counterclockwise relative to the process cartridge C, which causes the shutter portion 28c to expose the opening 12b 1 of the bottom frame member 12b as shown in FIG. 15, and when the process cartridge C is completely inserted, the photosensitive drum 7 is exposed as shown in FIG. 1.

Conversely, when the process cartridge C having been installed is removed from the apparatus main assembly 16, the shutter member 28 automatically closes due to the pressure from the torsion coil spring 28e following reversely the aforementioned opening steps.

If the bottom light transmitting window 10a7 is covered by the shutter portion 28c after the process cartridge C is installed and the shutter portion 28c is moved, the light from the light emitting element 22a fails to reach the light receiving element 22b, which makes it impossible to detect whether the toner remains or not.

In the case of the process cartridge C of this embodiment, the width (length in the direction in which the recording medium is conveyed) of the opening portion 12b1 provided in the bottom frame member 12b is approximately 24 mm, and the width (length in the direction in which the recording medium is conveyed) of the shutter portion 28c capable of protecting satisfactorily this opening portion 12b1 by covering it is approximately 42 mm, wherein the distance between the opening portion 12b1 and the bottom light transmitting window 10a7 is approximately 35 mm.

In order to detect precisely the presence or absence of the toner, it is preferable to dispose the light transmitting window 10a7 sufficiently close to the developing sleeve 10c, and when the distance between the opening portion 12b1 and light transmitting window 10a7 is increased, the developing sleeve 10c disposed close to the photosensitive drum 7 is farther separated from the light transmitting window 10a7, which is liable to deteriorate the accuracy in detecting the presence or absence of the toner.

Therefore, in this embodiment, the bottom light transmitting window 10a7 is disposed close to the opening portion 12b1, and the lengths of the shutter arm 28a and shutter linkage 28b are selected so that when the process cartridge C is installed into the apparatus main assembly 16, the shutter portion 28c moves past the bottom light transmitting window 10a7 to a location where it does not block the light path R (FIG. 1).

With such an arrangement, the presence or absence of the toner can be detected with satisfactory precision, while affording the satisfactory projection of the photosensitive drum 7 when the process cartridge C is out of the apparatus main assembly 16.

Figure 12:
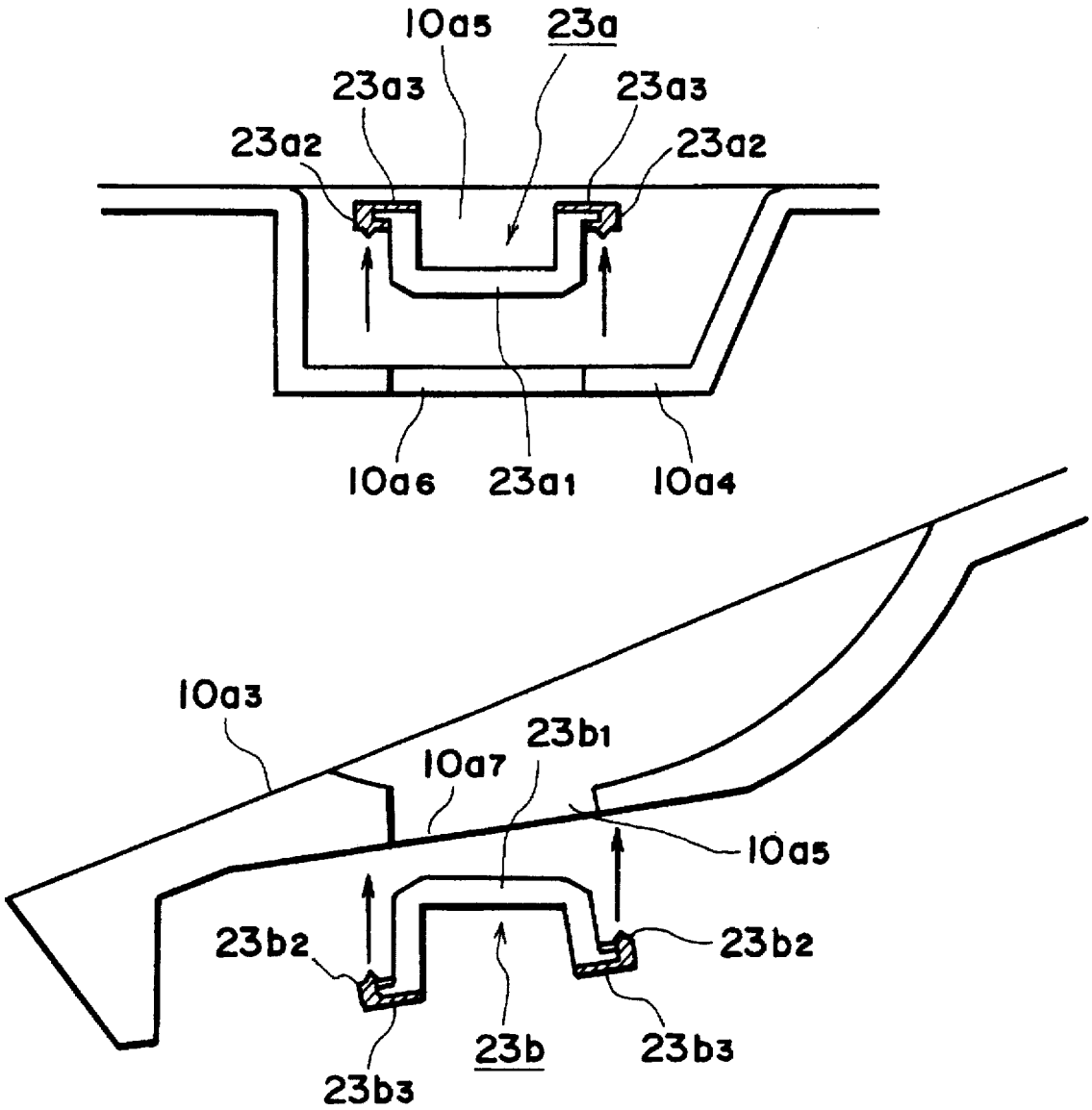
FIG. 12 is an explanatory structural view of the light transmitting member, describing how the member is fitted.

It is evident from FIG. 12 that the light transmitting members 23a and 23b are given a curvature so that when they are fitted in the light transmitting windows 10a6 and 10a7, the light transmission portions project inward from the exterior surface of the frame member 12a. Therefore, when the process cartridge C is held by a hand, it is not liable that the light transmitting portions 23a1 and 23b1 of the light transmitting members 23a and 23b come in contact with a finger or the like. In addition, when the shutter portion 28c moves past the light transmitting member 23b, the shutter portion 28c does not scratch the light transmitting portion 23b1 by rubbing it. Further, only the light transmitting portion 23b1 of the light transmitting member 23b may be projected inward from the surface of the frame member to prevent it from being rubbed by the shutter portion 28c.

(Controlling means)

Next, controlling means for driving the various portions will be described referring to the block diagram in FIG. 16.

Figure 16:
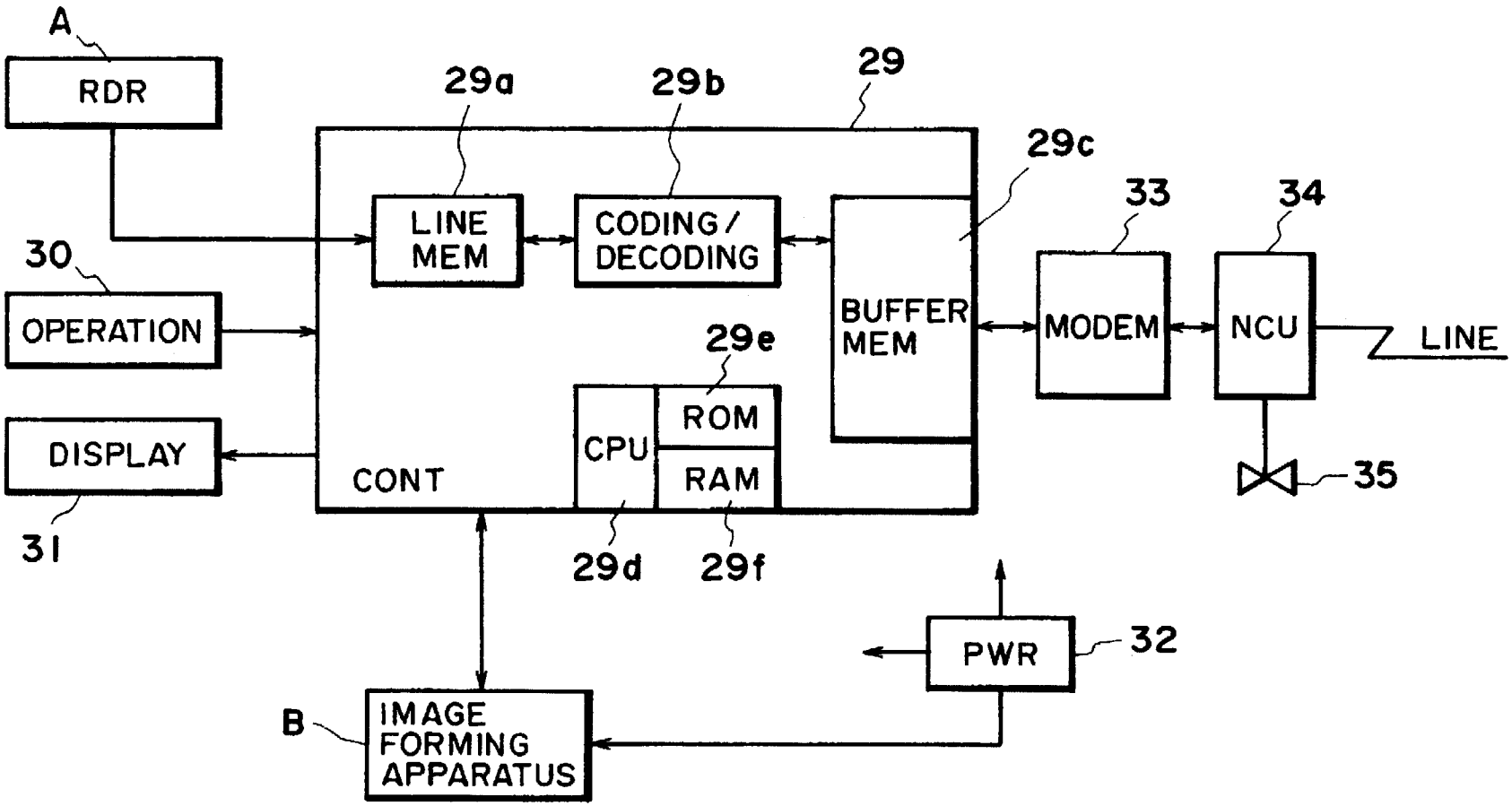
FIG. 16 is a block diagram of a control system.

In FIG. 16, the reading apparatus A photoelectronically reads the original 13 and outputs the results as digital signals, which are sent to a controlling portion 29, and then, the motor or the like for driving the rollers for conveying the original is driven by the controlling portion 29 under its control.

The controlling portion 29 comprises a line memory 29a for storing each of the line image data of the image date. When the apparatus is in a transmission or copy mode, this line memory 29a stores a single line equivalent of the image data sent from the reading apparatus A, and when the apparatus is in an image data receiving mode, it stores a single line equivalent of the received image data. The image forming operation is carried out as the stored data is sent to the image forming apparatus B.

A reference 29b designates an encoding/decoding portion which encodes the image information to be transmitted, using the MH coding or the like, or decodes the received coded image data into the plain image data. A reference 29c designates a buffer memory for storing the encoded image data to be transmitted or that has been received. These portions of the controlling portion 29 are controlled by a CPU 29d such as a microprocessor or the like. Further, the controlling portion 29 comprises, in addition to the CPU 29d, a ROM 29e which stores a control program for the CPU 29d as well as various data, a RAM 29f which serves as the work area to store temporarily the various data, and the like portions. The image forming apparatus B is driven under the control of the controlling portion 29.

A reference numeral 30 designates a control panel comprising various function keys such as a key to start the transmission or the like: input keys for telephone numbers; and the like, and 31 designates a display portion which normally displays various functions of the control panel, or the apparatus status such as the presence or absence of the toner.

A reference numeral 33 designates a power source for supplying electrical power through the entire apparatus; 33, a modem (modulating/demodulating device); 34, a network net work control unit (NCU); and 35, telephone equipment.

The controlling portion R9 drives the reading apparatus A and image forming apparatus B under its control to carry out the original reading operation and the image forming operation. It also receives signals from the light receiving element 22b constituting the aforementioned remaining toner amount detecting means, end when it determines that there is no toner, it displays "no toner" on the display portion, and at the same time, stops driving the image forming apparatus B.

EMBODIMENT 2

Figure 17A:
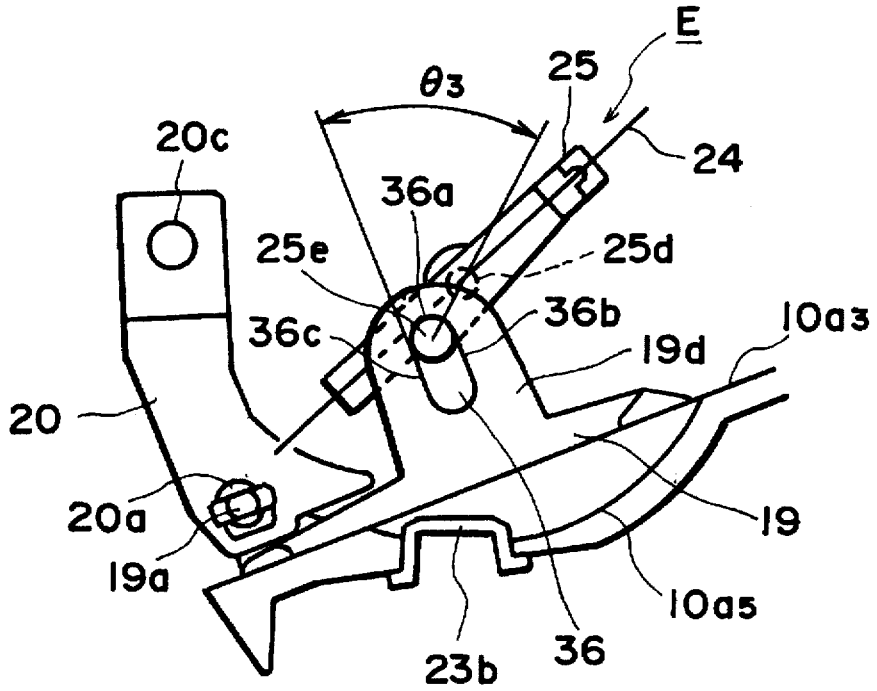
FIGS. 17A and 17B are explanatory structural views of another embodiment of a stopper which regulates the rotational angle of the cleaning member.
Figure 17B:
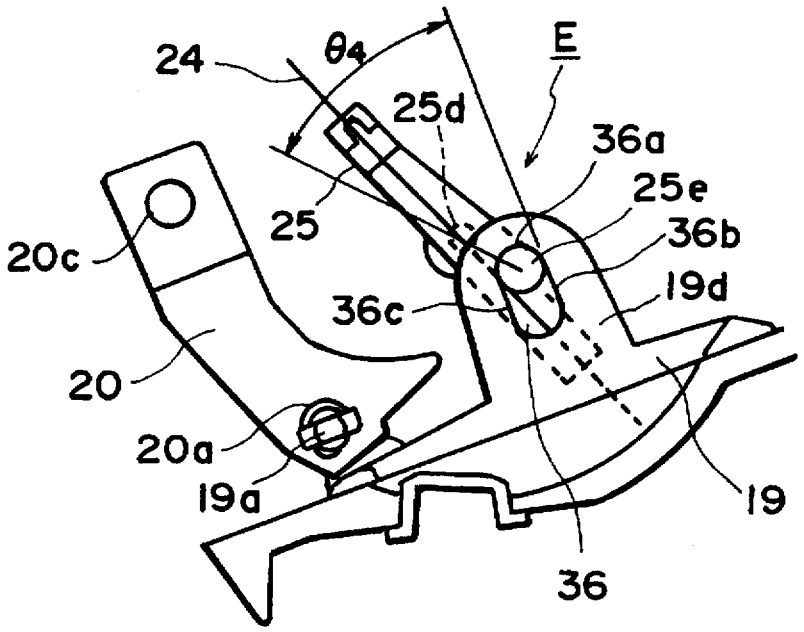

Next, a different structure for the stopper which regulates the rotational angle of the cleaning member E will be described as a second embodiment of the present invention, referring to FIGS. 17A and 17B. The members in this embodiment having the same functions as those in the first embodiment will be given the same reference symbols and their descriptions need not be repeated.

The stirring member 19 and cleaning member E in this embodiment are also reciprocatively moved and rotated, respectively, by the same mechanism as that of the first embodiment. However, in this second embodiment, the rib 19 provided on the stirring member 19, which had the U-shaped groove 19*c* in the first embodiment, is provided with an elongated hole 36 in place of the U-shaped groove.

As for the position of the top portion 36*a* of the elongated hole 36, it is so arranged that the driving axis 25*e* and the top portion 36*a* of the elongated hole 36 come into contact at the same time when angles θ3 and θ4 formed between the straight line connecting the rotational axis 25*d* and driving axis 25*e* of the cleaning member E and the sliding surfaces 36*b* and 36*c* of the elongated hole 36, respectively, reach predetermined angles as the cleaning member E is rotated. The other structures are the same as those in the first embodiment.

With the employment of the above described structure, when the cleaning member E tends to rotate more than the predetermined angle, the top portion 36*a* of the elongated hole 36 makes contact with the driving axis 25*e* of the cleaning member E, regulating thereby further rotation of the cleaning member E. Therefore, the angles θ3 and θ4 formed between the straight line connecting the rotational axis 25*d* and driving axis 25*e* of the cleaning member E and the sliding surfaces 36*b* and 36*c* of the elongated hole 36, respectively, remain below the predetermined angles; therefore, the cleaning member E smoothly rotates in the reciprocative manner.

Further, the role of the stopper which regulates the rotational angle of the cleaning member E is given to the rib 19*d* of the stirring member 19 which transmits the driving force to the cleaning member E; therefore, the positional relation between the top portion 36*a* of the elongated hole 36 provided with the function as the stopper and the rib 19*d* provided with the function to drive the cleaning member E can be precisely maintained with the use of a simple structure. As a result, the angles θ3 and θ4 formed between the straight line connecting the rotational axis 25*d* and driving axis 25*e* of the cleaning member E and the sliding surfaces 36*b* and 36*c* of the elongated hole 36, respectively, can be maintained wish high precision. Therefore, the driving axis 25*e* of the cleaning member E and the sliding surfaces 36*b* and 36*c* of the elongated hole 36 smoothly slide against each other.

Also in this embodiment, the rotational angle of the cleaning member E is selected to match the material for the driving axis 25*e* and the rib 19*d* of the stirring member 19 so that the driving axis 25*e* and rib 19*d* smoothly slide against each other.

EMBODIMENT 3

Figure 18:
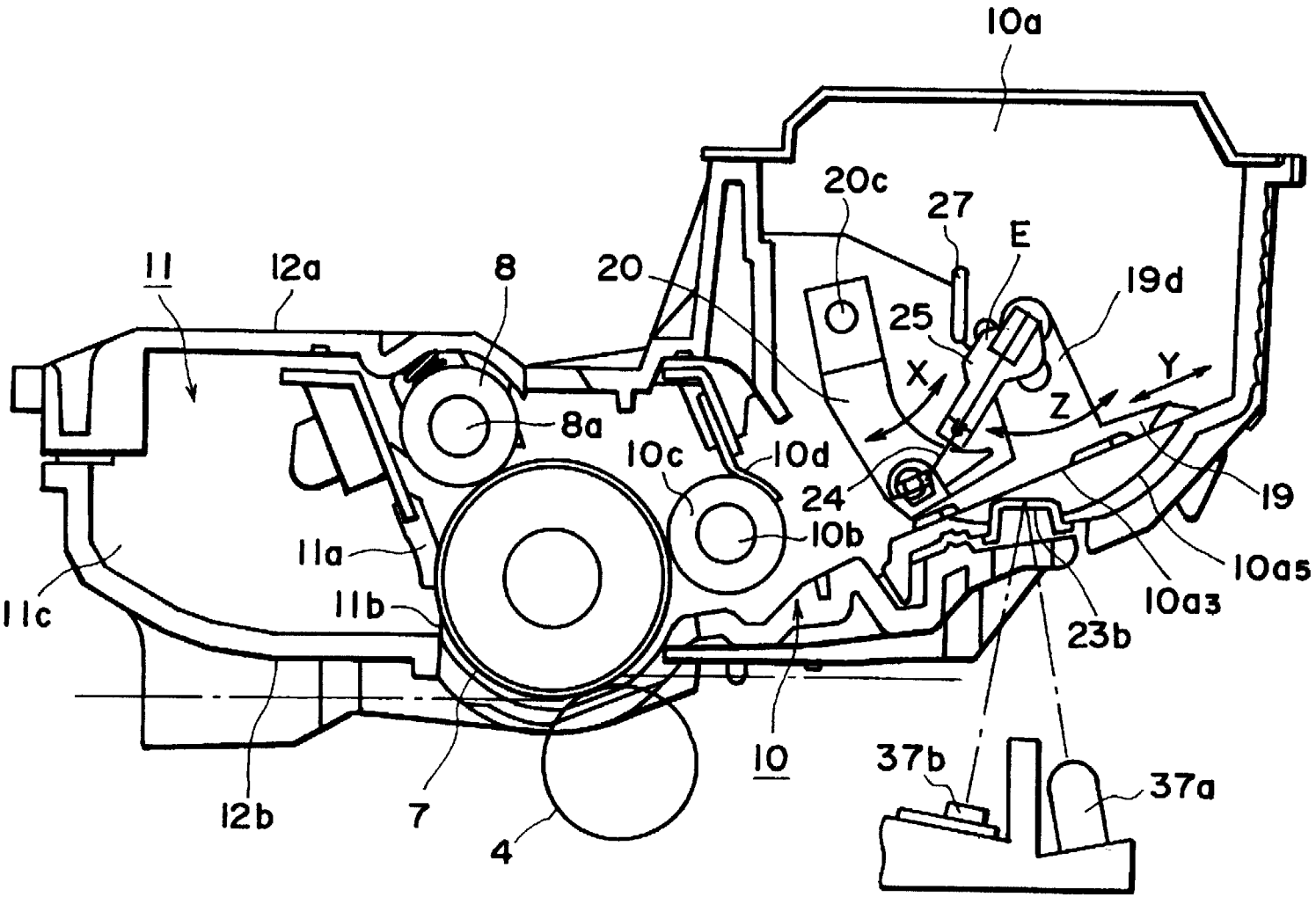
FIG. 18 is an explanatory drawing of another embodiment of the present invention, in which a light reflecting type optical sensor is employed.

Next, a different embodiment of the light sensor for detecting the remaining amount of the toner will be described as the third embodiment of the present invention, referring to FIG. 18. Also in this embodiment, the members having the same functions as those in the first embodiment will be designated by the same reference symbols so that the previous descriptions need not be repeated.

In the first embodiment, a structural example in which the light from the light emitting element 22*a* was caused to reach the light receiving element 22*b* through the inside of the toner storing container 10*a* was presented, but in this embodiment, the light emitting element 37*a* and light receiving element 37*b* are disposed at the bottom portions of the process cartridge C having been installed in the apparatus main assembly 16. The light from the light emitting element 27*a* is reflected by a light transmitting member 23*b* fitted in the light transmitting window 10*a*7 provided in the bottom wall of the toner storing container 10*a*, and the reflected light reaches the light receiving element 37*b*.

In the case of this structure, when there remains the toner in the toner storing container 10*a*, the toner covers the area of the light transmitting member 23*b*. This toner, for example, black toner, has a smaller reflectance; therefore, the light from the light emitting element 37*a* is likely to reach the light receiving element 37*b* by a smaller amount, which decreases the output value of the light receiving element 37*b*. On the other hand, when there remains no toner in the toner storing container 10*a*, and therefore, no toner is covering the area of the light transmitting member 23*b*, the internal members (for example, stirring member or the like) of the toner storing container 10*a* are exposed through the light transmitting member 23*b*. As a result, the light reaches the light receiving member 37*b* by the amount correspondent to the reflectance of the color of the exposed member. Therefore, the presence or absence of the toner can be determined by producing the stirring member 19 or the like using material with a reflectance different from that of the toner.

In this third embodiment, only the light transmitting window 10*a*7 and light transmitting member 23*b* disposed on the bottom side of the process cartridge C are necessary, and therefore, the cleaning member E has to clean only the light transmitting member 23*b*.

Further, when the remaining amount of the toner is to be detected by the reflection type sensor as described before, it is preferable to dispose the light transmitting window in the bottom wall of the process cartridge C, but it is not a mandatory requirement. Instead of the bottom wall, the light transmitting window may be placed only in the top wall.

OTHER EMBODIMENTS

The present invention can be applied not only to a process cartridge such as the aforementioned process cartridge C for forming a monochromatic image, but also to such a cartridge that comprises two or more developing means for forming a multicolor image (for example, two-color image, three-color image, or full-color image).

As for the developing method, various developing methods such as the well-known magnetic brush developing method of the two component type, cascade developing method, touch-down developing method, cloud developing method, or the like may be employed.

As for the image bearing member, it is not limited to the aforementioned photosensitive drum 7. The available choices include the following. Firstly, photoconductive material is used as the photosensitive member, wherein the photoconductive material includes, for example, amorphous silicon, amorphous selenium, zinc oxide, titanium oxide, and the organic photoconductive material (OPC) or the like. As for the shape of the base member on which the photosensitive material is coated, it may be of a shape of a rotary drum or belt, a sheet-shape, or the like. Generally speaking, a base member of the drum-shape or belt-shape is employed. In the case of the drum type photosensitive member, for example, it is produced by vapor depositing or coating the photoconductive material on a cylinder of aluminum alloy or the like.

As for the structure of the charging means, a so-called contact charging method was employed in the first embodiment, but it is needless to say that a different structure may be employed. For example, a conventional method may be employed in which a metallic shield of aluminum or the like is placed to surround a tungsten wire from three sides, wherein positive or negative ions generated by applying a high voltage to the tungsten wire are transferred to the surface of the photosensitive drum to charge uniformly the surface of this drum.

As the aforementioned charging means, various charging means of different types may be employed besides the roller type: blade type (charging blade), pad type, block type, rod type, wire type, and so on.

As for the cleaning method for cleaning the toner remaining on the photosensitive drum, cleaning means comprising a blade, a fur brush, a magnetic brush, or the like may be employed.

The process cartridge referred hereinbefore is such a process cartridge that comprises an electrophotographic photosensitive member, and at least, developing means as one of the processing means. Therefore, various types of process cartridges may be employed in addition to the one described in the preceding embodiments; for example, a combination of an electrophotographic photosensitive member, developing means, and charging means may be integrated into a form of cartridge removably installable into the apparatus main assembly; a combination of an electrophotographic photosensitive member and developing means may be integrated into a form of cartridge removably installable into the apparatus main assembly; a combination of an electrophotographic photosensitive member, developing means, and cleaning means may be integrated into a form of cartridge removably installable into the apparatus main assembly; and the like.

In other words, the aforementioned process cartridge means such a process cartridge which is produced by integrating the charging means, cleaning means, developing means, and electrophotographic photosensitive member in the form of a cartridge removably installable into the main assembly of an image forming apparatus; such a cartridge which is produced by integrating the charging means or cleaning means, developing means, and electrophotographic photosensitive member in the form of a cartridge removably installable into the main assembly of the image forming apparatus; or such a cartridge which is produced by integrating at least the developing means and electrophotographic photosensitive member in the form of a cartridge removably installable into the main assembly of the image forming apparatus.

Further, the preceding embodiments exemplified that the photosensitive drum and developing sleeve are integrated in the form of a cartridge which is installed into the image forming apparatus to form an image. However, the present invention is also applicable to an image forming apparatus in which the photosensitive drum and developing sleeve are directly mounted without being integrated in the form of cartridge. In other words, the image forming apparatus may be such one in which the toner storing container is directly attached to the apparatus main assembly, and the aforementioned stirring means, remaining toner amount detecting means, cleaning means, or the like are disposed so as to be enabled to deal with the toner contained in this toner storing container.

Further, in the preceding embodiments, a facsimile was chosen as an example of an apparatus comprising the image forming apparatus. However, the present invention is not required to be limited to these embodiments. It is needless to say that the present invention is also applicable to other forms of image forming apparatuses, for example, electrophotographic copying machine, laser beam printing apparatus, word processor, or the like.

As described in the foregoing, the toner in the toner container is stirred by in a reciprocable member, and therefore, the usable shape of the toner container is not limited to a cylindrical shape, but irregular shape is usable. Accordingly, required space can be reduced, and the space can be saved.

By making the stroke of the reciprocal motion of the cleaning member larger than the stroke of the stirring member, the light transmitting member can be sufficiently cleaned without stirring too much the toner in the toner container.

As described hereinbefore, according to the present invention, the position to which the shutter member retracts when the process cartridge is installed is located at a position past the light transmitting member. Therefore, even when the shutter member is rendered wide enough to protect satisfactorily the electrophotographic photosensitive member, the shutter member in the retracting position does not cover the light transmitting member, allowing thereby highly precise detection of the remaining amount of the toner. In addition, the width of the shutter can be increased to protect satisfactorily the electrophotographic photosensitive member. Therefore, the present invention can afford both the projection of the electrophotographic photosensitive member and the toner detection.

While the invention has been described with reference to the structures disclosed herein, it is not confined to the details set forth and this application is intended to cover such modifications or changes as may come within the purposes of the improvements or the scope of the following claims.

What is claimed is:

1. An apparatus, useable with an image forming apparatus, for developing a latent image formed on an electrophotographic photosensitive member, said apparatus comprising:

a developing member for developing the latent image formed on the electrophotographic photosensitive member;

a toner container for containing toner to be used by said developing member to develop the latent image;

a light transmitting member for transmitting light for detecting that an amount of the toner in said toner container is smaller than a predetermined level;

a cleaning member, disposed in said toner container, for cleaning an inside surface of said light transmitting member;

a toner stirring member, disposed in said toner container, for stirring the toner contained in said toner container;

a driving member for receiving a driving force from the image forming apparatus when said apparatus is mounted to said image forming apparatus;

a stirring member reciprocating means for receiving the driving force from said driving member to reciprocate said toner stirring member; and cleaning member reciprocation means for receiving the driving force from said driving member to reciprocate said cleaning member with a degree of displacement larger than that of said stirring member.

2. An apparatus according to claim 1, wherein said cleaning member reciprocation means comprises a shaft for rotating a supporting member for supporting said cleaning member, and said shaft is at a position deviated from a position where a transmission means for transmitting the driving force from said driving member to said supporting member is engaged with said supporting member.

3. An apparatus according to claim 2, wherein an amount of deviation is smaller than a distance between said shaft and an end of said cleaning member.

4. An apparatus according to claim 1, wherein said light transmitting member comprises a first light transmitting member and a second light transmitting member, wherein said first light transmitting member transmits light emitted from a light emitting means, in a main assembly of the image forming apparatus, into said toner container, and said second light transmitting member transmits the light through said toner container to outside thereof, wherein said cleaning member cleans inside surfaces of said first and second light transmitting members.

5. An apparatus according to claim 4, wherein said cleaning member comprises a first portion supported on an end of a supporting member and a second portion supported on the other end of said supporting member, and the first portion cleans the inside surface of said first light transmitting member, and the second portion cleans the inside surface of said second light transmitting member.

6. An apparatus according to claim 1 or 5, wherein said cleaning member is formed of elastic material for contacting a surface of said light transmitting member both in forward and backward strokes of reciprocal movement.

7. A process cartridge according to claim 2, wherein said transmission means is driven by reciprocal movement of said stirring member.

8. A process cartridge detachably mountable to a main assembly of an image forming apparatus, comprising:

a) an electrophotographic photosensitive member; and b) a developing device for developing a latent image on said electrophotographic photosensitive member, including:

a toner container for containing toner to be used by said developing device for developing the latent image;

a light transmitting member for transmitting light for detecting that an amount of the toner in said toner container is smaller than a predetermined level;

a cleaning member, disposed in said toner container, for cleaning an inside surface of said light transmitting member;

a toner stirring member, disposed in said toner container, for stirring the toner contained in said toner container:

a driving member for receiving a driving forge from the main assembly when said process cartridge is mounted to said image forming apparatus;

a stirring member reciprocating means for receiving the driving force from said driving member to reciprocate said toner stirring member; and cleaning member reciprocation means for receiving the driving force from said driving member to reciprocate said cleaning member with a degree of displacement larger than that of said stirring member.

9. A process cartridge according to claim 8, further comprising charging means for charging said electrophotographic photosensitive member.

10. A process cartridge according to claim 8 or 9, further comprising cleaning means for cleaning said photosensitive member.

11. A cartridge according to claim 8, wherein said cleaning member reciprocation means comprises a shaft for rotating a supporting member for supporting said cleaning member, and said shaft is at a position deviated from a position where a transmission means for transmitting the driving force from said driving member to said supporting member is engaged with said supporting member.

12. A cartridge according to claim 8, wherein an amount of deviation is smaller than a distance between said shaft and an end of said cleaning member.

13. A cartridge according to claim 8, wherein said light transmitting member comprises a first light transmitting member and a second light transmitting member, wherein said first light transmitting member transmits light emitted from a light emitting means, in the main assembly of the image forming apparatus, into said toner container, and said second light transmitting member transmits the light through said toner container to outside thereof, wherein said cleaning member cleans inside surfaces of said first and second light transmitting members.

14. A cartridge according to claim 13, wherein said cleaning member comprises a first portion supported on an end of a supporting member and a second portion supported on the other end of said supporting member, and the first portion cleans the inside surface of said first light transmitting member, and the second portion cleans the inside surface of said second light transmitting member.

15. A cartridge according to claim 8, wherein said cleaning member is formed of elastic material for contacting the inside surface of said light transmitting member both in forward and backward strokes of reciprocal movement.

16. A process cartridge according to claim 11, wherein said transmission means is driven by reciprocal movement of said stirring member.

17. An image forming apparatus to which a process cartridge is detachably mountable, comprising:

a) mounting means for mounting a process cartridge, said process cartridge including:

an electrophotographic photosensitive member;

a developing member for developing a latent image formed on said electrophotographic photosensitive member;

a toner container for containing toner to be used by said developing member for developing the latent image;

a light transmitting member for transmitting light for detecting that an amount of the toner in said toner container is smaller than a predetermined level;

a cleaning member, disposed in said toner container, for cleaning an inside surface of said light transmitting member;

a toner stirring member, disposed in said toner container, for stirring the toner contained in said toner container;

a driving member for receiving a driving force from a main assembly when said process cartridge is mounted to said image forming apparatus;

a stirring member reciprocating means for receiving the driving force from said driving member to reciprocate said toner stirring member; and cleaning member reciprocation means for receiving the driving force from said driving member to reciprocate said cleaning member with a degree of displacement larger than that of said stirring member; and b) detecting means for detecting that the amount of the toner in said toner container is smaller than the predetermined level.

18. An apparatus according to claim 17, wherein said light transmitting member comprises a first transmitting member and a second transmitting member, and said detecting means includes a photosensor for detecting light and a light emitting element for emitting light, and said image forming apparatus is stopped in response to detection of the light by said photosensor, wherein when a remaining amount of the toner is reduced to the predetermined level, the light emitted by said light emitting element travels through said first transmitting member, inside of said toner container and said second transmitting member to said photosensor, whereby said detecting means detects that the amount of the toner in said container is smaller than the predetermined level.

19. A developing apparatus, useable with an image forming apparatus, for developing a latent image formed on an electrophotographic photosensitive member, said apparatus comprising:

a developing member for developing the latent image formed on the electrophotographic photosensitive member;

a toner container for containing toner to be used by said developing member to develop the latent image;

a light transmitting member for transmitting light for detecting that an amount of the toner in said toner container is smaller than a predetermined level;

a reciprocable stirring member, disposed in said toner container, for stirring the toner in said toner container;

a cleaning member, disposed in said toner container, for cleaning an inside surface of said light transmitting member;

a driving member for receiving a driving force from the image forming apparatus when said developing apparatus is mounted to said image forming apparatus;

a stirring member reciprocating means for receiving the driving force from said driving member to reciprocate said reciprocable stirring member; and cleaning member reciprocation means for receiving the driving force from said driving member to reciprocate said cleaning member with a degree of displacement larger than that of said stirring member.

20. An apparatus according to claim 19, wherein said cleaning member is supported on a supporting member rotatable about an axis, and said cleaning member reciprocation means is driven by reciprocal motion of said stirring member, and has a reciprocable member engageable with said supporting member at a position deviated from said axis.

21. An apparatus according to claim 20, wherein an amount of deviation is smaller than a distance between said axis and an end of said cleaning member.

22. An apparatus according to claim 19, wherein said light transmitting member comprises a first light transmitting member and a second light transmitting member, wherein said first light transmitting member transmits light emitted from a light emitting means, in a main assembly of the image forming apparatus, into said toner container, and said second light transmitting member transmits the light through said toner container to outside thereof, wherein said cleaning member cleans inside surfaces of said first and second light transmitting members.

23. An apparatus according to claim 22, wherein said cleaning member comprises a first portion supported on an end of a supporting member and a second portion supported on the other end of said supporting member, and the first portion cleans the inside surface of said first light transmitting member, and the second portion cleans inside surface of said second light transmitting member.

24. An apparatus according to claim 19 or 23, wherein said cleaning member is formed of elastic material for contacting a surface of said light transmitting member both in forward and backward strokes of reciprocal movement.

25. An apparatus according to claim 19 wherein said reciprocation means has a transmission means for transmitting a driving force to said cleaning member to reciprocate said cleaning member with degree of displacement larger than that of said transmission means.

26. An image forming apparatus to which a process cartridge is detachably mountable, comprising:

a) mounting means for mounting a process cartridge, said process cartridge including:

an electrophotographic photosensitive member;

a developing member for developing a latent image formed on said electrophotographic photosensitive member;

a toner container for containing toner to be used by said developing member for developing the latent image;

a light transmitting member for transmitting light for detecting that an amount of the toner in said toner container is smaller than a predetermined level;

a reciprocable stirring member, disposed in said toner container, for stirring the toner in said toner container;

a cleaning member, disposed in said toner container, for cleaning an inside surface of said light transmitting member;

a driving member for receiving a driving force from the main assembly when said process cartridge is mounted to said image forming apparatus;

a stirring member reciprocating means for receiving the driving force from said driving member to reciprocate said reciprocable stirring member; and cleaning member reciprocation means for receiving the driving force from said driving member to reciprocate said cleaning member with a degree of displacement larger than that of said stirring member; and b) detecting means for detecting that the amount of the toner in said toner container is smaller than the predetermined level.

27. An apparatus according to claim 26, wherein said light transmitting member comprises a first transmitting member and a second transmitting member, and said detecting means includes a photosensor for detecting light and a light emitting element for emitting light, and said image forming apparatus is stopped in response to detection of the light by said photosensor, wherein when a remaining amount of the toner is reduced to the predetermined level, the light emitted by said light emitting element travels through said first transmitting member, inside of said toner container and said second transmitting member to said photosensor, whereby said detecting means detects that the amount of the toner in said container is smaller than the predetermined level.

28. A developing apparatus, useable with an image forming apparatus, for developing a latent image formed on an electrophotographic photosensitive member, said apparatus comprising:

a developing member for developing the latent image formed on the electrophotographic photosensitive member;

a toner container for containing toner to be used by said developing member to develop the latent image;

a first light transmitting member, provided in said toner container, for transmitting light emitted from a light emitting means into said toner container;

a second light transmitting member, provided in said toner container, for transmitting the light through said toner container to outside thereof;

a reciprocable stirring member, disposed in said toner container, for stirring the toner in said toner container;

a first cleaning member, disposed in said toner container and supported on an end of a supporting member, for cleaning an inside surface of said first light transmitting member;

a second cleaning member, supported on another end of said supporting member, for cleaning said second light transmitting member;

a driving member for receiving a driving force from the image forming apparatus when said developing apparatus is mounted to said image forming apparatus;

a stirring member reciprocating means for receiving the driving force from said driving member to reciprocate said reciprocable stirring member; and cleaning member reciprocation means for receiving the driving force from said driving member to reciprocate said first cleaning member and said second cleaning member with a degree of displacement larger than that of said stirring member.

29. An apparatus according to claim 28, wherein said reciprocation means comprises transmission means for transmitting reciprocating force of said stirring member to said supporting member, said transmission means being engaged with said supporting member at a position deviated from a rotational shaft of said supporting member.

30. An apparatus according to claim 29, wherein an amount of deviation is smaller than a distance between an axis of the rotational shaft and an end of one of said first cleaning member and said second cleaning member.

31. An apparatus according to claim 28 or 30, further comprising a stopper for the reciprocal motion.

32. An apparatus according to claim 31, further comprising a bearing for said supporting member integral with said stopper, said bearing supporting said first cleaning member and said second cleaning member.

33. A process cartridge detachably mountable to a main assembly of an image forming apparatus, comprising:

a) an electrophotographic photosensitive member; and b) a developing device for developing a latent image on said electrophotographic photosensitive member, including:

a toner container for containing toner to be used by said developing device for developing the latent image;

a first light transmitting member, provided in said toner container, for transmitting light emitted from light emitting means into said toner container;

a second light transmitting member, provided in said toner container, for transmitting the light through said toner container to outside thereof;

a reciprocable stirring member, disposed in said toner container, for stirring the toner in said toner container;

a first cleaning member, supported on an end of a supporting member, for cleaning said first light transmitting member;

a second cleaning member, supported on another end of a supporting member, for cleaning said second light transmitting member;

a driving member for receiving a driving force from the main assembly when said process cartridge is mounted to said image forming apparatus;

stirring member reciprocating means for receiving the driving force from said driving member to reciprocate said reciprocable stirring member; and cleaning member reciprocation means for receiving the driving force from said driving member to reciprocate said first cleaning member and said second cleaning member with a degree of displacement larger than that of said stirring member.

34. A process cartridge according to claim 33, further comprising charging means for charging said electrophotographic photosensitive member.

35. A process cartridge according to claim 33 or 34, further comprising cleaning means for cleaning said photosensitive member.

36. A cartridge according to claim 33, wherein said reciprocation means comprises transmission means for transmitting reciprocating force of said stirring member to said supporting member, said transmission means being engaged with said supporting member at a position deviated from a rotational shaft of said supporting member.

37. A cartridge according to claim 36, wherein an amount of deviation is smaller than a distance between an axis of the rotational shaft and an end of one of said first cleaning member and said second cleaning member.

38. A cartridge according to claim 33, further comprising a stopper for the reciprocal motion.

39. A cartridge according to claim 38, further comprising a bearing for said supporting member integral with said stopper, said bearing supporting said first cleaning member and said second cleaning member.

40. An image forming apparatus to which a process cartridge is detachably mountable, comprising:

a) mounting means for mounting a process cartridge, said process cartridge including:

an electrophotographic photosensitive member;

a developing member for developing a latent image formed on said electrophotographic photosensitive member;

a toner container for containing toner to be used by said developing member for developing the latent image;

a first light transmitting member, provided in said toner container, for transmitting light emitted from light emitting means into said toner container;

a second light transmitting member, provided in said toner container, for transmitting the light through said toner container to outside thereof;

a reciprocable stirring member, disposed in said toner container, for stirring the toner in said toner container;

a first cleaning member, disposed in said toner container and supported on an end of supporting member, for cleaning an inside surface of said first light transmitting member;

a second cleaning member, disposed in said toner container and supported on another end of a supporting member, for cleaning an inside surface of said second light transmitting member;

a driving member for receiving a driving force from a main assembly when said process cartridge is mounted to said image forming apparatus;

a stirring member reciprocating means for receiving the driving force from said driving member to reciprocate said reciprocable stirring member; and cleaning member reciprocation means for receiving the driving force from said driving member to reciprocate said first cleaning member and said second cleaning member with a degree of displacement larger than that of said stirring member; and b) detecting means for detecting that the amount of the toner in said toner container is smaller than the predetermined level.

41. An apparatus according to claim 40, wherein said detecting means includes a photosensor for detecting light and said light emitting means for emitting light, and said image forming apparatus is stopped in response to detection of the light by said photosensor, wherein when a remaining amount of the toner is reduced to the predetermined level, the light emitted by said light emitting means travels through said first light transmitting member, inside of said toner container and said second light transmitting member to said photosensor, whereby said detecting means detects that the amount of the toner in said container is smaller than the predetermined level.

42. An apparatus according to claim 17, 26 or 40, wherein said image forming apparatus is a facsimile machine and has reading means for reading information from an original, and transmitting means for transmitting image information therefrom.

43. A process cartridge detachably mountable to a main assembly of an image forming apparatus, comprising:

a) an electrophotographic photosensitive member; and b) a developing device for developing a latent image on said electrophotographic photosensitive member, including:

a toner container for containing toner to be used by said developing device for developing the latent image;

a first light transmitting member, provided in said toner container, for transmitting light emitted from a light emitting element into said toner container;

a second light transmitting member, provided in said toner container, for transmitting the light through said toner container to outside thereof;

a reciprocable stirring member, disposed in said toner container, for stirring the toner in said toner container;

a first cleaning element, supported on an end of a supporting member, for cleaning said first light transmitting member;

a second cleaning element, supported on another end of said supporting member, for cleaning said second light transmitting member;

a driving member for receiving a driving force from the main assembly when said process cartridge is mounted to said image forming apparatus;

a stirring member reciprocating device for receiving the driving force from said driving member to reciprocate said reciprocable stirring member;

a cleaning member reciprocation device for receiving the driving force from said driving member to reciprocate said first cleaning element and said second cleaning element with a degree of displacement larger than that of said stirring member, wherein said stirring member reciprocation device comprises a transmission for transmitting a reciprocating force of said stirring member to said supporting member, said transmission being engaged with said supporting member at a position deviated from a rotational shaft of said supporting member, wherein the deviation is smaller than a distance between an axis of the rotational shaft and an end of one of the first and second cleaning elements;

a stopper for stopping the reciprocal motion; and a bearing for said supporting member integral with said stopper, said bearing supporting said first and second cleaning elements; and c) a charging device for charging said electrophotographic photosensitive member.

44. A process cartridge detachably mountable to a main assembly of an image forming apparatus, comprising:

a) an electrophotographic photosensitive member; and b) a developing device for developing a latent image on said electrophotographic photosensitive member, including:

a toner container for containing toner to be used by said developing device for developing the latent image;

a light transmitting member for transmitting light for detecting that an amount of the toner in said toner container is smaller than a predetermined level;

a reciprocable toner stirring member, disposed in said toner container, for stirring the toner contained in said toner container;

a cleaning member, disposed in said toner container, for cleaning an inside surface of said light transmitting member;

a driving member for receiving a driving force from the main assembly when said process cartridge is mounted to said image forming apparatus;

a stirring member reciprocating means for receiving the driving force from said driving member to reciprocate said toner stirring member; and cleaning member reciprocation means for receiving the driving force from said driving member to reciprocate said cleaning member with a degree of displacement larger than that of said stirring member.

45. A process cartridge according to claim 44, further comprising charging means for charging said electrophotographic photosensitive member.

46. A process cartridge according to claim 45 or 44, further comprising cleaning means for cleaning said photosensitive member.

47. A cartridge according to claim 44, wherein said cleaning member is supported on a supporting member rotatable about an axis, and said reciprocation means is driven by reciprocal motion of said stirring member, and has a reciprocable member engageable with said supporting member at a position deviated from said axis.

48. A cartridge according to claim 47, wherein an amount of deviation is smaller than a distance between said axis and an end of said cleaning member.

49. A cartridge according to claim 44, wherein said light transmitting member comprises a first light transmitting member and a second light transmitting member, wherein said first light transmitting member transmits light emitted from a light emitting means, in the main assembly of the image forming apparatus, into said toner container, and said second light transmitting member transmits the light through said toner container to outside thereof, wherein said cleaning member cleans inside surfaces of said first and second light transmitting members.

50. A cartridge according to claim 49, wherein said cleaning member comprises a first portion supported on an end of a supporting member and a second portion supported on the other end of said supporting member, and the first portion cleans the inside surface of said first light transmitting member, and the second portion cleans the inside surface of said second light transmitting member.

51. A cartridge according to claim 44, wherein said cleaning member is formed of elastic material for contacting the inside surface of said light transmitting member both in forward and backward strokes of reciprocal movement.

52. A process cartridge according to claim 36, wherein said reciprocation means comprises a transmission means for transmitting a driving force to said cleaning member to reciprocate said cleaning member with degree of displacement larger than that of said transmission means.

* * * * *

UNITED STATES PATENT AND TRADEMARK OFFICE

CERTIFICATE OF CORRECTION

PATENT NO. : 5,682,574
DATED : October 28, 1997
INVENTOR(S) : Haruhisa OSHIDA et al.

It is certified that error appears in the above-identified patent and that said Letters Patent is hereby corrected as shown below:

ON THE COVER PAGE:

Item [57] Abstract:

Line 3, "include" should read--includes--.

Column 1:

Line 16 "1-319065." should read --1·319065).--.
Line 23, "is" should be deleted.
Line 31, "an" should read --a--.
Line 39, "therefrom" should read --therefrom.--.

Column 2:

Line 13, "starring" should read --stirring--.
Line 40, "To" should read --to--.

Column 3:

Line 41, "a" (first occurrence) should read --an--.
Line 51, "photosensitize" should read --photosensitive--.
Line 58, "photosensitize" should read --photosensitive--.

Column 5:

Line 35, "the both" should read --both the--.

UNITED STATES PATENT AND TRADEMARK OFFICE

CERTIFICATE OF CORRECTION

PATENT NO. : 5,682,574
DATED : October 28, 1997
INVENTOR(S) : Haruhisa OSHIDA et al.

It is certified that error appears in the above-identified patent and that said Letters Patent is hereby corrected as shown below:

Column 6:

Line 24, "photosensitize" should read --photosensitive--.

Column 7:

Line 13, "toughened" should read --roughened--.
Line 44, "photosensitize" should read --photosensitive--.
Line 48, "as it is" should read --as is--.

Column 9:

Line 21, "Structure" should read --structure--.
Line 53, "light," should read --light--.

Column 10:

Line 10, "add" should read --and--.
Line 22, "which is" should read --is--.

Column 11:

Line 15, "here" should read --there--.
Line 24, "is" should read --it--.

UNITED STATES PATENT AND TRADEMARK OFFICE

CERTIFICATE OF CORRECTION

PATENT NO. : 5,682,574
DATED : October 28, 1997
INVENTOR(S) : Haruhisa OSHIDA et al.

It is certified that error appears in the above-identified patent and that said Letters Patent is hereby corrected as shown below:

Column 13:

Line 55, "end" should read --and--.
Line 66, "25c" should read --25e--.

Column 14:

Line 13, "he" should read --the--.
Line 52, "terephthalete" should read --terephthalate--.
Line 53, "wider" should read --wiper--.

Column 15:

Line 50, "mean," should read --means,--.

Column 16:

Line 36, "This" should read --this--.

Column 18:

Line 22, "date." should read --data.--.
Line 54, "net work" should be deleted.
Line 60, "end" should read --and--.

UNITED STATES PATENT AND TRADEMARK OFFICE

CERTIFICATE OF CORRECTION

PATENT NO. : 5,682,574
DATED : October 28, 1997
INVENTOR(S) : Haruhisa OSHIDA et al.

It is certified that error appears in the above-identified patent and that said Letters Patent is hereby corrected as shown below:

Column 21:

Line 19, "referred" should read --referred to--.

Column 22:

Line 8, "in" should be deleted.
Line 30, "projection" should read --protection--.

Column 23:

Line 50, "forge" should read --force--.

Column 25:

Line 64, "inside" should read --the inside--.

Column 26:

Line 6, "degree" should read --a degree--.
Line 67, "outside" should read --the outside--.

Column 28:

Line 46, "of" should read --of a--; and
Lines 57 - 58, there should be no line break between "said" on line 57 and "driving" on line 58.

UNITED STATES PATENT AND TRADEMARK OFFICE

CERTIFICATE OF CORRECTION

PATENT NO. : 5,682,574
DATED : October 28, 1997
INVENTOR(S) : Haruhisa OSHIDA et al.

It is certified that error appears in the above-identified patent and that said Letters Patent is hereby corrected as shown below:

Column 30:

Line 61, "36," should read --44,--.
Line 64, "degree" should read --a degree--.

Signed and Sealed this

Thirteenth Day of October 1998

*Attest:*

Bruce Lehman

BRUCE LEHMAN

*Attesting Officer*

*Commissioner of Patents and Trademarks*